US007326508B2

(12) United States Patent
Maeyama et al.

(10) Patent No.: US 7,326,508 B2
(45) Date of Patent: Feb. 5, 2008

(54) IMAGE FORMING METHOD

(75) Inventors: Ryuichiro Maeyama, Ebina (JP); Hidehiko Soyama, Minamiashigara (JP); Tsukasa Matsuda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 406 days.

(21) Appl. No.: 11/071,314

(22) Filed: Mar. 4, 2005

(65) Prior Publication Data

US 2006/0056887 A1 Mar. 16, 2006

(30) Foreign Application Priority Data

Sep. 14, 2004 (JP) ..... 2004-266988

(51) Int. Cl.
*G03G 13/20* (2006.01)

(52) U.S. Cl. ..... 430/124.1; 430/124.5; 430/111.4; 399/320; 399/328; 399/329

(58) Field of Classification Search ..... 430/124.1, 430/124.5, 111.4; 399/320, 328, 329
See application file for complete search history.

(56) References Cited

U.S. PATENT DOCUMENTS

2003/0152857 A1* 8/2003 Sugiura et al. ..... 430/109.2

FOREIGN PATENT DOCUMENTS

| | | |
|---|---|---|
| JP | A 63-282752 | 11/1988 |
| JP | A 2-183270 | 7/1990 |
| JP | A 6-250439 | 9/1994 |
| JP | A 2003-51902 | 2/2003 |
| JP | A 2003-316172 | 11/2003 |

* cited by examiner

*Primary Examiner*—Mark A. Chapman
(74) *Attorney, Agent, or Firm*—Oliff & Berridge, PLC

(57) ABSTRACT

An image forming method, including forming an unfixed toner image on the surface of paper by an electrophotographic process using a developer containing a toner, and fixing the toner image on the paper, wherein a toner amount of the unfixed toner image is in the range of about 2.0 to 4.5 g/m$^2$ for a toner image formed using a toner of one color, and in the range of about 8.0 to 18 g/m$^2$ for a toner image formed by layering toners of four or more colors, and a bulk density of the toner is in the range of about 0.2 to 0.5 g/cm$^3$.

15 Claims, 5 Drawing Sheets

IMAGE FORMING METHOD

CROSS-REFERENCE TO RELATED APPLICATION

This application claims priority under 35 USC 119 from Japanese Patent Application No. 2004-266988, the disclosure of which is incorporated by reference herein.

BACKGROUND OF THE INVENTION

1. Field of the Invention

The present invention relates to an image forming method for use in an electrophotographic apparatus, such as a copying machine, a facsimile machine, or a printer.

2. Description of the Related Art

With the improvements in electrophotographic recording apparatuses in recent years, the use of so-called on-demand printing has become common. Here coated paper is used, that previously would have been used in commercial printing, such as offset printing, and a digital signal is color printed on demand on glossy coated paper by an electrophotographic process. Because of this, progress has been made in increasing speeds and improving image quality of color copying machines and color printers.

With respect to a higher image quality, with electrostatic latent images becoming finer due to improvements in resolution of the apparatuses, in order to develop an electrostatic latent image faithfully and obtain images of higher image quality, the particle size of toner is becoming smaller and smaller in recent years. In particular, for a full-color copying machines that develop, transfer, and fix digital latent images with chromatic color toners, image quality has improved to a certain degree by adopting toners having small particle sizes whose volume average particle size is in the range of 6 to 8 μm. However, in order to meet the need for yet higher resolutions (improvements in fine line reproducibility, improvements in gradation, etc.), the particle size of toner has to be made even smaller and to be in an appropriate particle size distribution.

Meanwhile, when the volume average particle size of toner exceeds 8 μm, toner with a bulk density exceeding 0.5 g/cm$^3$, when the toner is layered to form an unfixed image, the voids become so large that toner forming the image is readily scattered, which gives rise to the problem of rough images. Conversely, when a bulk density of toner is too low, voids in the toner forming a toner image become smaller, which readily gives rise to blisters.

A blister is a minute void developed on the surface of a toner image portion. The mechanism responsible for the development of a blister is as follows. That is, water within the paper turns into moisture vapor when heated during the process of fixing the toner image. When the paper has low air permeability, the moisture vapor is not released to the outside, and vapor pressure within the paper increases to the extent that the moisture vapor breaks through the toner layer to be released.

In particular, in the case of coated paper having high sheet gloss for use in commercial printing, the surface of paper is coated then smoothened by calendaring to confer the required sheet gloss to the paper. In this instance, the paper is flattened by a pressure applied during the process of calendaring, and the air permeability is thereby reduced. This readily gives rise to blisters during the process of fixing the toner image.

In addition, in a case where such printing coated paper is used as paper stock, the paper size varies with changes of water content in the paper. In the case of a full-color copying machine or printer adopting the indirect dry-type electrophotographic process, water content in the paper changes when the toner is heat-fixed onto the paper. This poses another problem that the outputted paper curls.

With respect to smaller particle sizes, a toner manufacturing method by emulsion aggregation process is proposed as a method of systematically controlling the shape and the surface structure of toner particles (for example, see JP-A Nos. 63-282752 and 6-250439). Because in an emulsion aggregation process, the particularized raw material of the starting material is normally 1 μm or smaller, in theory, it is possible to manufacture toners of small particle sizes efficiently.

However, a toner of a small particle size manufactured by this method is of a spherical shape, and there is a tendency that the bulk density of the toner is increased, which generally gives an adverse effect on the suppression of blisters. In addition, when a toner of a small particle size is used, the toner falls into the formation of the paper. This causes a problem that resulting images are rough.

In order to cope with this problem, there has been proposed a method for suppressing the occurrence irregularities of releasing agent in a hard copy image by supplying a releasing agent, such as silicone oil, to the fixing member and using a toner furnished with a releasing agent function containing wax (for example, see JP-A No. 2003-316172). However, the occurrence of blisters is not attributable to the chemical properties of the toner, and they occur simply due to the presence of voids resulting from the shape of the toner particles. Hence, blisters still occur even when releasing agent is applied to the fixing member or a toner prepared by adding wax to a pulverized toner is used.

In addition, in order to suppress the occurrence of blisters during the process of fixing toner images, regulating the toner amount on a print medium at the image forming apparatus side has been proposed (for example, see JP-A No. 2003-51902). To be more specific, the toner amount on a print medium is controlled according to print medium used and print mode. Further, an optimum toner amount on a print medium for a toner containing particles having a particle size of 16 μm or greater has been proposed (for example, see JP-A No. 2-183270). However, both proposals fail to take into account interaction in the toner, and therefore it cannot be said that they are sufficient image forming frameworks capable of suppressing blisters and improving image quality.

SUMMARY OF THE INVENTION

The present invention has been made in view of the above-mentioned circumstances, and the invention provides an image forming method capable of suppressing the occurrence of blisters or image roughness during the process of fixing the toner image, without the need to strictly control, according to the print medium used and the print mode, the toner amount on a print medium.

One aspect of the invention provides an image forming method, including forming an unfixed toner image on a surface of paper by an electrophotographic process using a developer containing a toner, and fixing the unfixed toner image on the paper. Wherein, a toner amount of the unfixed toner image is in a range of about 2.0 to 4.5 g/m$^2$ for a toner image formed using a toner of one color, and in a range of about 8.0 to 18 g/m$^2$ for a toner image formed by layering toners of four or more colors, and a bulk density of the toner is in a range of about 0.2 to 0.5 g/cm$^3$.

DETAILED DESCRIPTION OF THE INVENTION

Figure 1:
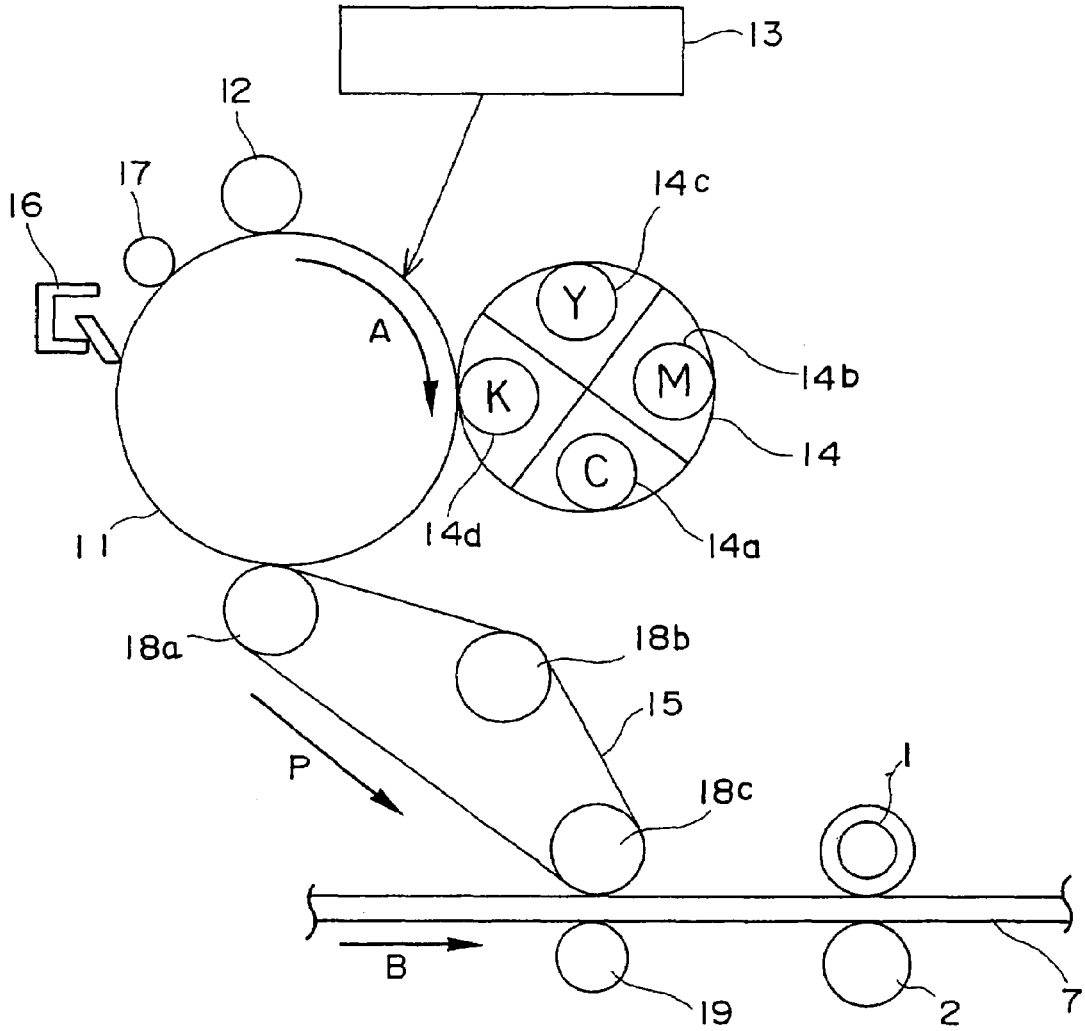
FIG. 1 is a view schematically showing the configuration of one preferred example of an electrophotographic image forming apparatus used in an image forming method of the present invention.

The present invention will now be described in detail.

An image forming method of the invention is an image forming method, including forming an unfixed toner image on the surface of paper by an electrophotographic process using a developer containing a toner, and fixing the unfixed toner image on the paper. The method is characterized in that a toner amount of the unfixed toner image is in the range of about 2.0 to 4.5 g/m$^2$ for a toner image formed using a toner of one color, and in the range of about 8.0 to 18 g/m$^2$ for a toner image formed by layering toners of four or more colors, and a bulk density of the toner is in the range of about 0.2 to 0.5 g/cm$^3$.

The inventors conducted assiduous research into the problems discussed above, and discovered that these problems can be addressed at a higher level by specifying a range of bulk density of the toner. That is to say, in the case of a conventional toner, the toner amount of unfixed toner image cannot be increased, because when the toner amount of the unfixed toner image is increased, so is the bulk of the toner image, which gives rise to toner scattering. In contrast, in the invention it was discovered that image roughness caused by toner scattering can be prevented, even when the toner amount of the unfixed toner image is increased, by limiting the bulk density of the toner to 0.5 g/cm$^3$ or below.

It is inferred that when the bulk density of toner is limited to be within a certain range, an electrostatic binding force among toner particles is increased, and although apparently the density is reduced, the toner forming the toner images has a structure that remains stationary during the process of fixing the toner image.

A toner and a developer used in the image forming method of the invention will be described first.

As a toner and a developer that can be used in the image forming method of the invention, the followings are suitable.

Examples of resin components of a suitable toner used in the image forming method of the invention generally include, but not limited to, amorphous polyester resins, crystalline polyester resins, styrene-acrylic resins, epoxy resins, and polyurethane resins. Pigment components in the suitable toner are not particularly limited, either, and known pigment components can be used without causing any trouble.

Any manufacturing method, such as pulverization and polymerization, can be adopted as a manufacturing method of the suitable toner. However, a preferable method is an emulsion aggregation process, by which a resin particle dispersion in which resin particles are dispersed is mixed with a coloring agent dispersion in which a coloring agent is dispersed, to allow the resin particles and the coloring agent to aggregate to particles as large as a toner particle size, and the resulting aggregated particles are heated and fused at a temperature as high as or higher than a glass transition point. Methods disclosed in JP-A No. 6-250439 and Japanese Patent No. 3141783, the disclosures of which are incorporated by reference herein, can be used as the emulsion aggregation process, however, the emulsion aggregation process is not limited to these disclosed methods.

A releasing agent can be used with the toner of the invention, and for example, a releasing agent can be mixed with the resin particle dispersion or the like. In this case, from the viewpoint of ensuring the electrostatic properties and durability, it is preferable to add more resin particle dispersion after the resin particles, the coloring agent particles, and the releasing agent particles are aggregated into particles, so that the resin particles deposit on the surface of the aggregated particles.

Specific examples of the releasing agents include: low molecular weight polyolefins, such as polyethylene, polypropylene, and polybutene; silicones showing a softening point when heated; fatty acid amides, such as oleic amide, erucic amide, ricinoleic amide, and stearic amide; vegetable waxes, such as carnauba wax, rice wax, candelilla wax, Japanese wax, and jojoba oil; animal waxes, such as bees wax; mineral and petroleum waxes, such as montan wax, ozokerite, ceresin, paraffin waxes, microcrystalline waxes, and Fischer-Tropsch waxes; and modified products of the foregoing. In the invention, from the viewpoint of ensuring the mold releasing property in a case where an oil-less fixing device is used, it is preferable to use polyethylene, paraffin, and carnauba waxes.

These waxes hardly dissolve in solvents such as toluene, in the vicinity of room temperature, and if they dissolve, a dissolved amount is extremely small. From these waxes, a dispersion of particles having a particle size of 1 μm or smaller can be manufactured by dispersing these waxes in water together with ionic surfactants and polyelectrolytes, such as polyacids and polybases, followed by heating at or above the melting point, and by dispersing them in the form of particles using a homogenizer or a pressure discharge dispersing machine (a Gaulin homogenizer, manufactured by APV Gaulin Inc.) having the ability to provide high shear. In addition, a polymerizable ultraviolet stabilization monomer or the like may be included as the need arises in order to improve the weatherability of images.

In a case where an oil-less fixing system is used, in order to ensure the separation properties of the fixed image, it is preferable to add releasing agent, in an amount in the range of about 5 to 25% by mass, and more preferably, in the range of about 7 to 20% by mass relative to a total mass of toner-forming solid contents. The particle size of the resulting releasing agent dispersion is measured using, for example, a laser scattering particle size distribution analyzer (LA-700, manufactured by Horiba, Ltd.).

In order to provide fluidity and improve the cleaning properties, the toner used in the image forming method of the invention may be a toner manufactured as follows. That is, as with a normal toner, after the toner is dried, inorganic particles, such as silica, alumina, titania, and calcium carbonate, or resin particles, such as a vinyl resin, polyester, silicone, are added to the surface of the toner particles while subjecting to shearing in a dry state. When deposited on the surface of toner particles when in water, examples of inorganic particles include all those normally used as external additives to the surface of toner particles, such as silica, alumina, titania, calcium carbonate, magnesium carbonate, and tricalcium phosphate, which are used by being dispersed in water with an ionic surfactant, polyacids, or polybases.

In the invention, the volume average particle size of toner is preferably in the range of about 2 to 7 μm, and more preferably, in the range of about 2 to 5 μm. When the volume average particle size of toner is smaller than 2 μm, the electrostatic property readily becomes insufficient, and the developing properties thereby deteriorated. Conversely, when the volume average particle size of toner exceeds 7 μm, the image resolution deteriorates or the bulk density of the toner as described below increases, which may give rise to image roughness when a toner amount of unfixed toner image is greater than a specific amount.

In addition, the volume average particle size distribution index GSDv of toner in the invention is preferably about 1.28 or below, and more preferably, about 1.25 or below. In particular, a toner manufactured by emulsion polymer coagulation can achieve a sharp particle size distribution. A case where GSDv exceeds 1.28 is not preferable, because in this case, the sharpness and the resolution of images deteriorate.

The volume average particle size and GSDv are determined in the following manner. That is, for example, based on a particle size distribution measured by a counter, such as a COULTER COUNTER TA-II (available from Nikkaki Co., Ltd.) a cumulative distribution for volume starting from the smallest particle sizes is first obtained. A particle size for which cumulative volume is at 16% is defined as a volume $D_{16v}$, a particle size for which the cumulative volume is at 50% is defined as a volume $D_{50v}$ (which is also defined as the volume average particle size), and a particle size for which the cumulative volume is at 84% is defined as a volume $D_{84v}$.

Then, the volume average particle size distribution index GSDv is calculated as $(D_{84v}/D_{16v})^{1/2}$.

A bulk density of toner in the invention is in the range of about 0.2 to 0.5 g/cm$^3$. When a bulk density of toner exceeds 0.5 g/cm$^3$, the toner scatters and image roughness occurs in a case where the toner image is formed with a toner amount of an unfixed image greater than a specific amount. Conversely, when a bulk density of toner is lower than 0.2 g/cm$^3$, it is difficult for air in the toner layer and moisture vapor in the paper to escape during the fixing process, giving rise to blisters.

A bulk density of toner is preferably in the range of about 0.25 to 0.5 g/cm$^3$, and more preferably, in the range of about 0.3 to 0.45 g/cm$^3$. A bulk density of toner is measured as follows using a powder tester (PTP type), manufactured by Hosokawa Micron Corporation.

That is, a 106-μm-mesh net is placed on a funnel of the powder tester. Then, 400 g of a toner to be measured is placed in the funnel to let the toner fall into a cylindrical container having an internal volume of approximately 25 ml and an inside diameter of approximately 30 mm by vibration at a vibration strength of 5.5. A bulk density is measured after the fallen toner is allowed to stand for one minute.

In the invention, the bulk density of toner can be controlled, for example, by the shape of the toner particles or electrostatic forces between toner particles, and control by the shape of the toner particles is preferred from the viewpoint of ease of control. To be more specific, the bulk density of toner is increased when the toner shape is close to spherical, and a bulk density of toner is reduced when the toner shape is irregular. Hence, the bulk density of toner can be set within the range specified above by controlling the shape of toner particles according to the volume average particle size of toner.

The shape of toner particles can be expressed numerically by an average value of shape factor SF1 defined by Formula (1) below. In the invention, the average value of shape factor SF1 of toner particles is preferably in the range of about 100 to 140, and more preferably, in the range of about 110 to 135.

$$SF1 = ML^2 \times 100\pi/4A \qquad \text{Formula (1)}$$

In Formula (1), ML represents the size of the maximum dimension of a toner particle, and A represents the projected area of the toner particle.

The shape factor SF1 is used as a factor to represent the configuration, such as the shape of toner particles, and is based on a statistical technique called image analysis, by which the area, length, shape, etc. of toner particles can be analyzed quantitatively at high accuracy from an image captured by an optical microscope or the like. For example, it can be measured by an image analyzer (Image Analyzer LUZEX III, manufactured by NIRECO Corporation, or the like).

In the invention, an average value of the shape factor SF1 is a value obtained by averaging values of the shape factors SF1 obtained by subjecting 200 toner particles, used as objects to be measured, to image analysis.

As is obvious from Formula (1) above, the shape factor SF1 is a numerical value obtained by dividing the square of the maximum dimension of a toner particle by the area of the toner particle, then multiplying the quotient by π/4, and multiplying the product by 100. It takes a value closer to 100 as the shape of toner particle gets closer to spherical. Conversely, it takes a larger value as the shape is elongated. In other words, a difference between the maximum particle dimension and the minimum particle dimension of a toner particle, that is, the shape factor SF1, is an index indicating a distortion. Hence, SF1=100 for a perfect sphere.

Developers that can be used in the image forming method of the invention are not particularly limited as long as they contain a toner, and can be of any composition that best suits the purpose. The developers include, for example, mono component developers made of toner alone and two-component developers made by combining a toner and a carrier.

Carriers used in the two-component developers are not particularly limited, and known carriers, such as resin coated carriers, disclosed, for example, in JP-A Nos. 62-39879 and 56-11461, the disclosures of which are incorporated by reference herein, can be used. A blending ratio of a toner and a carrier in the two-component developer is not particularly limited, either, and it can be set arbitrarily to best suit the purpose.

Paper used in the invention will now be described. Paper used in the invention may be normal paper that is not provided with a coating layer described below, or coated paper that is provided with a coating layer on the surface of a base material. Normal paper and the base material include not only base paper to which the surface treatment has been applied by a surface sizing agent, but also base paper to which the surface treatment has not been applied.

Pulp fibers used in the base paper for paper used in the invention are not particularly limited, and it is preferable to use, for example, kraft pulp fibers, sulfite pipe fibers, semi-chemical pulp fibers, chemi-mechanical pulp fibers, ground wood pulp fibers, refiner mechanical pulp fibers, thermo mechanical pulp fibers, etc. Also, fibers obtained by chemically modifying cellulose or hemicellulose in these fibers may be used as the need arises.

Further, cotton pulp fibers, hemp pulp fibers, kenaf pulp fibers, bagasse pulp fibers, viscose rayon fibers, regenerated cellulose fibers, cuprammonium rayon fibers, cellulose acetate fibers, polyvinyl chloride fibers, polyacrylonitrile fibers, polyvinyl alcohol fibers, polyvinylidene chloride fibers, polyolefin fibers, polyurethane fibers, polyvinyl chloride, a polyvinyl alcohol copolymer, fluorocarbon fibers, glass fibers, carbon fibers, alumina fibers, metal fibers, silicon carbide fibers, can be used, either singly or in combinations of two or more kinds.

In addition, fibers obtained by impregnating or heat-fusing the foregoing pulp fibers with synthetic resins, such as polyethylene, polypropylene, polystyrene, polyvinyl chloride, and polyester, may be used as the need arises.

Moreover, wood-free or wood-containing recycled pulp may be mixed in the base paper. An amount of recycled pulp to be mixed is determined depending on the use or purpose. However, for example, when recycled pulp is mixed from the viewpoint of resources conservation, an amount of recycled pulp to be mixed is preferably 10% by mass or greater, or more preferably, 30% by mass or greater, relative to a total mass of fibers.

A filler may be used for base paper used in the invention. A filler that can be used herein include: silicas, such as calcium carbonate heavy, calcium carbonate light, kaolin, calcined clay, pyrophyllite, sericite, and talc; inorganic fillers, such as titanium dioxide; and urea resin. Further, organic pigments, such as styrene, and thermoplastic resin particles based on polyester or styrene acryl may be mixed with the base paper.

An amount of the inorganic filler to be mixed in the base paper is preferably in the range of 0 to 10% by mass, and more preferably, in the range of 0 to 8% by mass, relative to a total mass of the base paper. In particular, because the thermoplastic organic pigment can be fused to fill in spaces among fibers by heat applied during the process of fixing the toner image, it is preferable to mix the thermoplastic organic pigment in the base paper in an amount in the range of 0 to 10% by mass, and more preferably, in the range of 0 to 5% by mass, relative to a total mass of the base paper. Mixing 10% by mass or more of thermoplastic organic pigment in the base paper is not preferable, because the opacity of a transfer sheet is deteriorated as with the case of impregnating the base paper with resins.

Also, various chemicals, such as sizing agents, can be added to base paper used in the invention, either internally or externally. The sizing agents include rosin sizing agents, synthetic sizing agents, petroleum resin sizing agents, neutral sizing agents. They can be used in a combination with an appropriate fixer for a sizing agent and fibers, such as aluminum sulfate and cationized starch.

Of all the foregoing, from the viewpoint of paper preservability after the paper is subjected to copying by an electrophotographic copying machine or printer, a neutral sizing agent, such as an alkenyl succinic anhydride sizing agent, an alkyl ketene dimmer, an alkenyl ketene dimmer, neutral rosin, petroleum sizing agent, an olefin resin, and a styrene-acrylic resin are preferable. In addition, denatured cellulose, such as oxidized denatured starch, enzyme denatured starch, polyvinyl alcohol, and carboxymethyl cellulose, can be used as a surface sizing agent, either singly or in combination.

Further, for base paper used in the invention, in order to adjust an electrical resistance of paper, inorganic materials, such as sodium chloride, potassium chloride, calcium chloride, sodium sulfate, zinc oxide, titanium dioxide, tin oxide, aluminum oxide, and magnesium oxide, and organic materials, such as alkyl phosphate, alkyl sulfate, sodium sulfonate, and quaternary ammonium salt, can be used, either singly or in a blended form.

Also, paper strengthening agents can be added either internally or externally. Examples of paper strengthening agents include starch, denatured starch, vegetable gum, carboxymethyl cellulose, polyvinyl alcohol, denatured polyvinyl alcohol, polyacrylamide, a styrene-maleic anhydride copolymer, a vinyl chloride-vinyl acetate copolymer, a styrene-butadiene copolymer, a urea polyacrylate-formaldehyde resin, a melamine-formaldehyde resin, dialdehyde starch, polyethyleneimine, epoxidized polyamide, a polyamide-epichlorohydrin resin, methylolated polyamide, a chitosan derivative, etc. These materials can be used, either singly or in a blended form.

Besides the various materials as described above, various assistants mixed with the base paper of normal coated paper, such as a dye and a pH adjuster, may be used as the need arises.

In the invention, coated paper in which a coating layer is formed on the surface of a base material can be used as paper. The coating layer is a layer containing a pigment and an adhesive, and an image with gloss can be formed due to the presence of such a coating layer. As has been described, base paper and the base paper to which the surface treatment has been applied are used as the base material.

Examples of the pigment contained in the coating layer include pigments used for normal coated paper for general use, such as mineral pigments, including calcium carbonate heavy, calcium carbonate light, titanium dioxide, aluminum hydroxide, satin white, talc, calcium sulfate, barium sulfate, zinc oxide, magnesium oxide, magnesium carbonate, amorphous silica, colloidal silica, white carbon, kaolin, calcined kaolin, delaminated clay, aluminosilicate, sericite, bentonite, and smectite, in addition to polystyrene resin particles, urea formaldehyde resin particles, micro hollow particles, and other organic pigments, which can be used either singly or in combination of two or more kinds.

The adhesive used for the coating layer is not particularly limited, and can be either a synthetic adhesive or a natural adhesive.

Examples of the synthetic adhesive include copolymers of styrene and butadiene, styrene and acryl, ethylene and vinyl acetate, butadiene and methylmethacrylate, vinyl acetate and butyl acrylate, in addition to polyvinyl alcohol, a maleic anhydride copolymer, and an acrylic acid-methylmethacrylate copolymer. One or more than one kind of adhesive selected from these synthetic adhesives can be used, and two or more kinds can be used in combination to best suite the purpose. When these synthetic adhesives are used, an amount to be used is preferably of the order of 5 to 50 parts by mass, and more preferably, of the order of 10 to 30 parts by mass, per 100 parts by mass of the pigments.

Examples of the natural adhesive include adhesives well known as natural adhesives, such as oxidized starch, esterified starch, and enzyme denatured starch, cold water soluble starch obtained by subjecting the foregoing starches to flash drying, in addition to casein and soybean protein. When these natural adhesives are used, an amount to be used is preferably of the order of 0.1 to 50 parts by mass, and more preferably, of the order of 2 to 30 parts by mass, per 100 parts by mass of the pigments.

Various assistants such as a dispersing agent, a thickener, a water retention agent, an anti-foam agent, and a water resistant additive, which are mixed with the normal pigment for coated paper can be used as the need arises.

The coating layer on coated paper is formed by preparing a coating composition by mixing the components described above, and by applying the coating composition on the both surfaces of the base material using an appropriate coating machine.

The prepared coating composition is applied on the both surfaces of the base material by a coating machine used when manufacturing normal coated paper, for example, a blade coater, an air knife coater, a roll coater, a reverse roll coater, a bar coater, a curtain coater, a die slot coater, a gravure coater, either on-machine or off-machine. The coating may be applied once; however, a single multi-layer coating layer may be formed by performing the coating a number of times. A coating film thickness of the coating layer has to be in the range of 5 to 15 g/m$^2$ on one surface of the base material by conversion of unit to an amount of solid contents (dry mass). The coating film thickness is set preferably in the range of 5 to 13 g/m$^2$, and more preferably, in the range of 6 to 11 g/m$^2$.

Smoothing treatment is applied as needed after the coating of the coating layer. A generally used smoothing machine, such as a super-calendar, a machine calendar, and a soft nip calendar, are used for the smoothing treatment, and it is preferable to finish coated paper to have sheet gloss of 15% or higher.

It is preferable that a basis weight (JIS P-8124, the disclosure of which is incorporated by reference herein) of the coated paper is in the range of about 60 g/m$^2$ to 260 g/m$^2$. When a basis weight is lower than 60 g/m$^2$, a heat quantity the coated paper receives during the process of fixing the toner image becomes so large that a vapor pressure is readily increased, which may possibly give rise to blisters.

In the invention, when coated paper is used as paper, it is particularly preferable to adjust air permeability (air permeability measured by the Oken method air permeability test according to J TAPPI Paper and Pulp Test Method No. 5, the disclosure of which is incorporated by reference herein) of the base material to be in the range of about 400 to 4000 sec. It is also preferable that the smoothness of the base material is in the range of about 200 to 9000 sec.

It is more preferable that the air permeability is in the range of about 500 to 3800 sec. When the air permeability exceeds 4000 sec., moisture vapor is released less due to heat and a pressure applied during the process of fixing the toner image, and a vapor pressure is readily increased. In particular, when a bulk density of toner is reduced, it may become difficult to suppress blisters. Conversely, when the air permeability is less than 400 sec., not only paper gloss is readily deteriorated, but also the strength of the coating layer is readily reduced, which may possibly give rise to paper powder or the like.

Further, when coated paper is used as paper, in order to prevent the occurrence of blisters while maintaining sheet glossiness on the surface of paper, it is preferable that the smoothness of the base material measured by the Oken method smoothness test is in the range of about 200 to 9000 sec.

It is more preferable that the smoothness is in the range of about 300 to 3800 sec. When the smoothness of the base material is less than 200 sec., the paper may fail to maintain sheet glossiness. Conversely, when the smoothness of the base material exceeds 9000 sec., blisters may possibly occur as described above.

The smoothness referred to herein means the smoothness measured by the Oken method smoothness test according to J TAPPI Paper and Pulp Test Method No. 5, and it is measured by an Oken method digital display air permeability and smoothness tester (Model Type: EY), manufactured by Asahi Seiko Co., Ltd.

In order to finish paper used in the invention, it is preferable to adjust a moisture content on the paper machine, so that a degree of moisture of the product immediately after the unsealing is in an adequate range, to be more specific, preferably of the order of 3 to 6.5% by mass, and more preferably, of the order of 4.5 to 5.5% by mass. In addition, in order to prevent moisture absorption and desorption during storage, it is preferable to pack the paper using moisture-proof packing paper, such as polyethylene laminated sheet or a material, such as polypropylene.

The image forming processes or the like in the image forming method of the invention using the toner and the paper described above will now be described.

The image forming method of the invention is an image forming method, including forming an unfixed toner image on the surface of paper by an electrophotographic process using a developer containing a toner, and obtaining a fixed image by heating and press-bonding the toner image. In the image forming method of the invention, any known image forming process can be used in the process of forming a toner image on the condition that the above-mentioned toner is used. For example, the process of forming a toner image includes: forming a latent image on a surface of a latent image holding member; developing the latent image using an electrophotographic developer; and transferring a developed toner image onto paper used as a transfer material.

Alternatively, a full-color image can be formed by adopting a method including: superimposing color toner images using an intermediate belt or the like provided between the latent image holding member and the transfer material; transferring the color toner images altogether at a time onto paper used as the transfer material; and fixing the toner color images on the paper by heat-fusion. The invention can adopt this alternative method, too.

In particular, because the toner of the invention as described above is used, even when various kinds of fixing device that have been known are used in the process of fixing the toner image, it is possible in the invention to prevent image roughness and the occurrence of blisters during the process of fixing the toner image.

An example of an image forming apparatus that can be used in the image forming method of the invention will now be described. FIG. 1 is a view schematically showing the configuration of one example of the image forming apparatus used suitably in the image forming method of the invention. The image forming apparatus shown in FIG. 1 is provided with a photoreceptor 11 that rotates in a direction indicated by an arrow A. Also, a roll-type charger 12, an exposing device 13, a developing device 14 housing developing units 14*a*, 14*b*, 14*c*, and 14*d* respectively holding developers of four colors of cyan, magenta, yellow, and black, a belt-shaped intermediate transferring member 15, a cleaner 16, and an optical static eliminator 17 are disposed in this order to surround the photoreceptor 11. The intermediate transferring member 15 is stretched over spindle rolls 18*a*, 18*b*, and 18*c*. The spindle roll 18*a* is pressed against the photoreceptor 11 via the intermediate transferring member 15. The spindle roll 18*c* is pressed by a transferring roll 19 via the intermediate transferring member 15. A toner image is transferred onto a transfer material (paper) 7 from the peripheral surface of the intermediate transferring member 15 by the transferring roll 19.

In the image forming apparatus shown in FIG. 1, an image is formed in the manner as follows. That is, the photoreceptor 11 is charged by the charger 12, and is exposed to lights by the exposing device 13 according to image information of any of four colors of cyan, magenta, yellow and black to form a latent image of the corresponding color on the surface of the photoreceptor 11. The latent image on the surface of the photoreceptor 11 is developed to a toner image by the developing unit for the corresponding color among the developing units 14*a*, 14*b*, 14*c*, and 14*d* housed in the developing device 14. The developed toner image is statically transferred onto the outer peripheral surface of the belt-shaped intermediate transferring member 15 at a portion opposing the spindle roll 18*a*.

After the toner image on the surface of the photoreceptor 11 is transferred onto the transfer material (paper) 7, the toner remaining on the surface of the photoreceptor 11 is removed by the cleaner 16. Also, residual charges remaining on the surface of the photoreceptor 11 are erased by the optical static eliminator 17. The photoreceptor 11 is then set ready to form a following image.

These operations are performed for each of four colors of cyan, magenta, yellow, and black, and an unfixed full-color toner image is formed on the outer peripheral surface of the intermediate transferring member 15 by successively layering toner images of respective colors on the outer peripheral surface of the intermediate transferring member 15.

As the intermediate transferring member 15 moves in a direction indicated by an arrow P, the full-color toner image formed on the outer peripheral surface of the intermediate transferring member 15 moves to a portion (nip portion) at which the spindle roll 18*c* and the transferring roll 19 are pressed against each other via the intermediate transferring member 15. When passing through the nip portion, the toner image on the outer peripheral surface of the intermediate transferring member 15 is transferred onto the surface of the transfer material 7 that is inserted in the nip portion and passes through the nip portion by moving in a direction indicated by an arrow B.

In the invention, a toner amount of an unfixed toner image which is obtained by developing a latent image on the surface of the photoreceptor and transferring a toner image on the paper as described above (hereinafter, the toner amount of the unfixed toner image is occasionally referred to as TMA) is in the range of about 2.0 to 4.5 g/m$^2$ for a toner image (monochrome image) formed using a toner of one color (when forming at a coverage ratio of 100%), and in the range of about 8.0 to 18 g/m$^2$ for a toner image (multi-color image) formed using toners of four or more colors.

When TMA exceeds 4.5 g/m$^2$ for a monochrome image and exceeds 18 g/m$^2$ for a multi-color image, the toner layer becomes so thick that image roughness occurs even when a bulk density of toner is maintained in the range specified above. Conversely, when TMA is less than 2.0 g/m$^2$ for a monochrome image and less than 8.0 g/m$^2$ for a multi-color image, it is impossible to ensure satisfactory color formation of the toner(s) in the resulting image.

In the invention, TMA is preferably in the range of about 2.5 to 4.5 g/m$^2$, and more preferably, in the range of about 2.5 to 4.0 g/m$^2$ for a monochrome image. Also, TMA is preferably in the range of about 9.0 to 18 g/m$^2$, and more preferably in the range of about 10 to 17 g/m$^2$ for a multi-color image.

A specific measuring method of TMA may be as follows. That is, an unfixed solid toner image is formed in a 4-cm$^2$ area on paper and the paper is weighed. Then, after the toner on the paper is removed by air blower, the mass of the paper alone is measured, and TMA is obtained by calculating a difference in mass before and after removal of the toner.

TMA can be controlled by changing an amount of electrostatic charge on the toner, developing bias, charging potential, etc. Also, from the perspective of apparatus used, a toner amount of an unfixed toner image can be set within the range specified in the invention by controlling a toner amount depending on print medium used and print mode as is described in JP-A No. 2003-51902, the disclosure of which is incorporated by reference herein.

The unfixed toner image on the surface of the transfer material (paper) 7 thus obtained is fixed on the surface of the transfer material 7 by the fixing device located downstream in the process of transferring the toner image. The fixing device is not particularly limited and any fixing device can be used as long as it is a fixing device that fixes a toner image on paper by heating and applying a pressure.

Examples of the fixing device used in the image forming method of the invention include contact-type heat fixing devices. The contact-type heat fixing devices includes: a heat-roll type fixing device that comprises a combination of a heating roll having a rubber elastic layer on the outer periphery of the cored bar and further provided with a fixing member surface layer as the need arises, and a pressurizing roll having a rubber elastic layer on the outer periphery of the cored bar and provided with a fixing member surface layer as the need arises; and a fixing device in which the roll-and-roll combination is replaced with a roll-and-belt or a belt-and-belt combination.

The fixing member referred to in the invention means a heating roll, a pressurizing roll, or a belt that heats and press-bonds the unfixed toner image formed on the paper.

A material having excellent heat resistance, a high strength against deformation, and good heat conductivity is selected for the core of the fixing member. In the case of a roll-type fixing device, for example, aluminum, iron, copper and the like are selected. In the case of a belt-type fixing device, for example, a polyimide film, a stainless belt and the like are selected. A rubber elastic layer made of silicone rubber, fluororubber or the like is normally provided on the surface of the core in the roll-type fixing device.

The core and the rubber elastic layer of the fixing member may contain various additives depending on the purpose for use. For example, carbon black, metallic oxide, and ceramic particles such as SiC, may be contained for the purpose of improving wear resistance and controlling a resistance value.

Some of the preferred examples of the contact-type heat fixing device used in the process of fixing the toner image in the invention will now be described.

Figure 2:
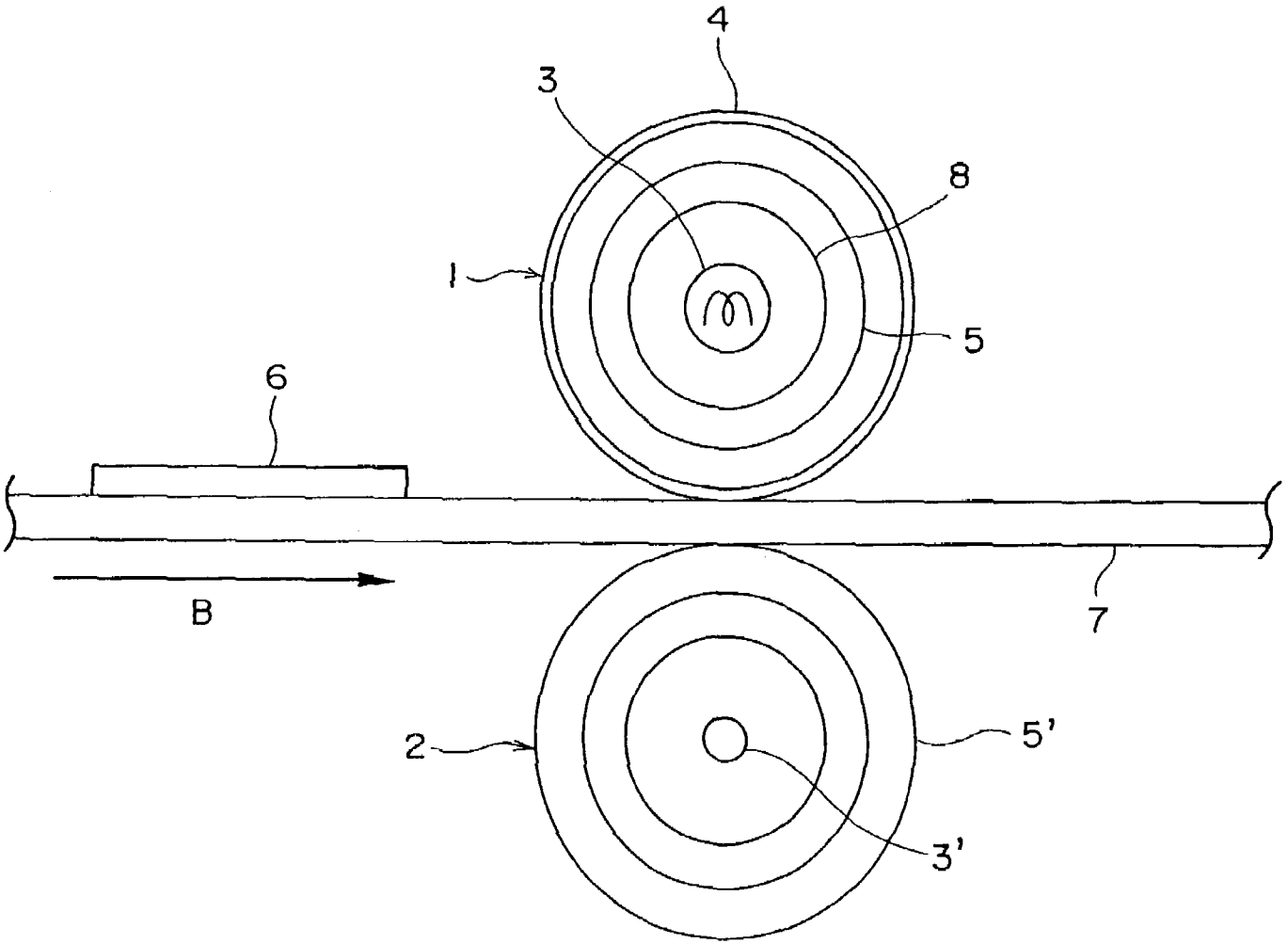
FIG. 2 is a view schematically showing the configuration of one example of a fixing device used in the image forming method of the invention.

An example of a heat-roll-type fixing device (fixing device I) will be described first in detail. The fixing device of this example is the one whose configuration is schematically shown in FIG. 2, and is adopted in the image forming apparatus shown in FIG. 1.

The fixing device chiefly comprises a fixing roll 1 in the shape of a roll, and a press-bonding roll 2 disposed so as to be opposed to the fixing roll 1. The fixing roll 1 has a heat source 3 in the interior to heat the fixing roll 1, and an elastic layer 5 is formed on the outer periphery of a core 8. Further, a surface layer 4 forming the surface of the fixing roll 1 is formed on the elastic layer 5.

When a transfer material (paper) 7, on which a toner image 6 is formed, is inserted in a nip portion between the press-bonding roll 2 and the fixing roll 1 as it moves in a direction indicated by an arrow B, the toner image 6 is heated and press-bonded to be fixed on the transfer material 7 while it passes through the nip portion.

The fixing device of this example may further include a cleaning member (not shown) to remove the toner adhering on the surface of the fixing roll 1, a heat source 3' to heat the press-bonding roll 2, and a claw (a finger, not shown) to separate the transfer material 7 from the fixing roll 1, as the need arises. The heat source 3 in the fixing device shown in FIG. 2 is controlled by a temperature controller (not shown) to keep a surface temperature of the fixing roll 1 at a constant temperature.

It is preferable to provide the elastic layer 5/5' of a single-layer or layered structure to the fixing roll 1 or the press-bonding roll 2 or to the both. Heat-resistant rubber, such as silicone rubber and fluororubber, is used for the elastic layer 5/5', and it is preferable that a rubber hardness (JIS-A) thereof is 60° or blow. When the fixing member is provided with the elastic layer 5/5', the fixing member undergoes deformation by following the irregularities on the toner image 6 formed on the transfer material 7, and it is therefore advantageous in that the surface of a fixed image can be smoother.

A thickness of the elastic layer 5/5' is preferably in the range of 0.1 to 3 mm, and more preferably, in the range of 0.5 to 2 mm. A too thick elastic layer 5/5' exceeding 3 mm is not preferable, because a heat capacity of the fixing member is increased, and not only it takes longer to heat the fixing member to a desired temperature, but also energy consumption is increased. A too thin elastic layer 5/5' having a thickness less than 0.1 mm is not preferable, either, because deformations on the surface of the fixing member can no longer follow the irregularities on the toner image. This may give rise to irregular fusion and the elastic layer does not undergo deformation in a manner effective for separation.

Figure 3:
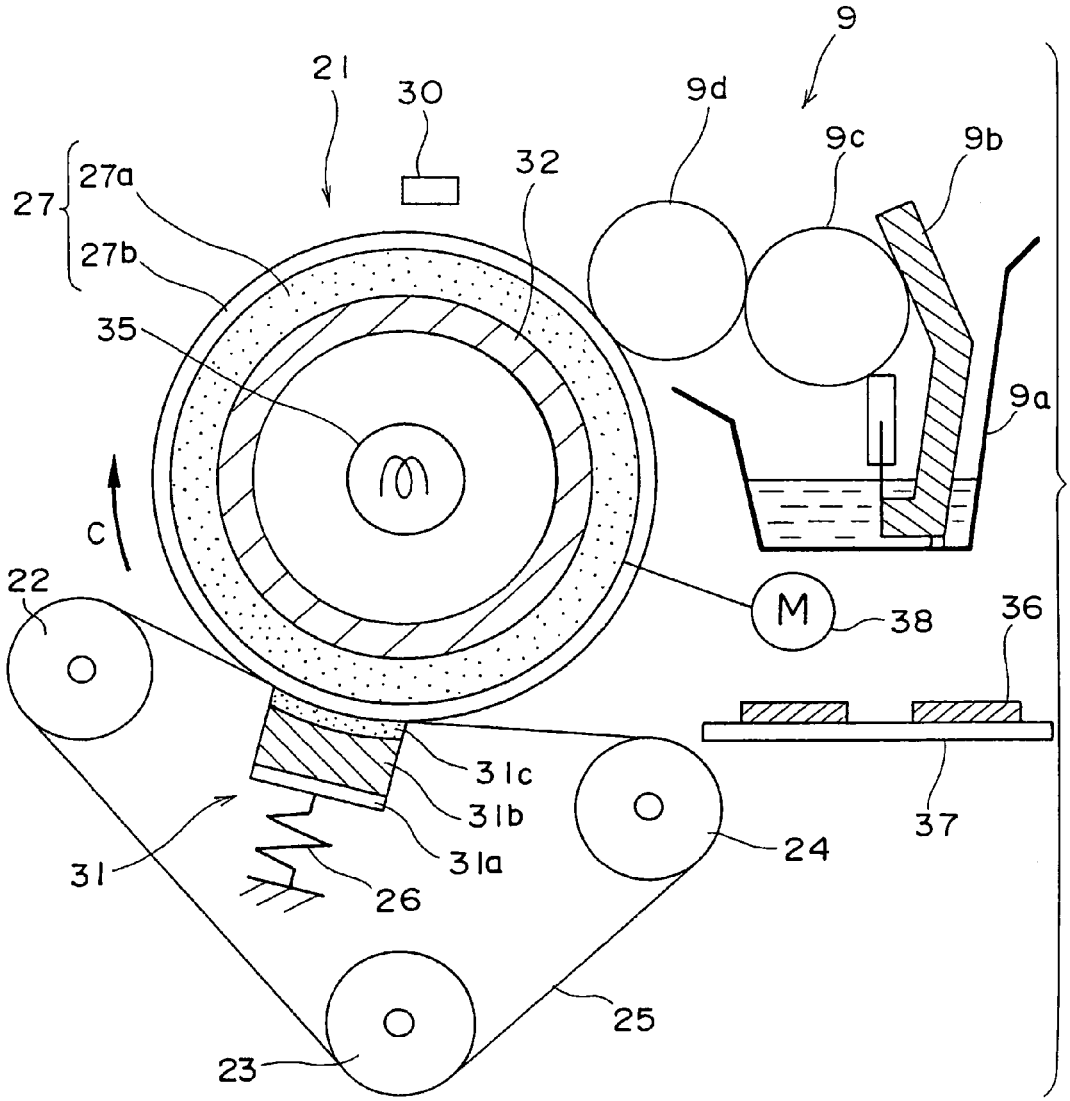
FIG. 3 is a view schematically showing the configuration of another example of a fixing device used in the image forming method of the invention.

An example of a belt-roll nip-type fixing device (fixing device II) will now be described in detail. The fixing device of this example is the one whose configuration is schematically shown in FIG. 3.

The major portion of the fixing device of this example comprises a fixing roll 21 housing a heat source, an endless belt 25 stretched over three supporting rolls 22, 23, and 24 and pressed against the fixing roll 21, and a pressure providing member 31 that abuts the inner surface of the endless belt 25 and presses the endless belt 25 along the surface of the fixing roll 21.

The fixing roll 21 has a cylindrical core 32 in the interior, and is driven by a motor 38 to rotate in a direction indicated by an arrow C. The core 32 is made of aluminum to have an outside diameter of 47 mm, an inside diameter of 42 mm, and a length of 350 mm. The surface of the core 32 is directly covered with HTV silicone rubber having a hardness (JIS-A) of 45° and provided in a thickness of 2 mm to serve as an undercoat layer 27*a*. Also, RTV silicone rubber is dip-coated on the undercoat layer 27*a* in a thickness of 50 μm to serve as a top coat layer 27*b*. These two layers form a covering layer 27, and the covering layer 27 is finished to have a surface state close to a mirror surface.

A hardness of the rubber forming the undercoat layer 27*a* is measured in accordance with JIS-K6301, the disclosure of which is incorporated by reference herein, using an A-type hardness tester of a spring type manufactured by TECLOCK, by applying a load of 9.8 N (1000 gf). The core 32 is not necessarily made of aluminum, and can be made of metals having high heat conductivity. Also, the covering layer 23 can be made of any other material as long as it is an elastic body having a high heat resistance.

A halogen lamp 35 having an output of 850 W is provided in the interior of the core 32 as a heat source. Also, a temperature sensor 30 is disposed on the surface of the fixing roll 21 to measure a temperature on the surface of the heat fixing roll 21. The halogen lamp 35 is controlled by an unillustrated temperature controller by feedback based on a measuring signal from the temperature sensor 30, so that, for example, a temperature on the surface of the heat fixing roll 21 is kept at 150° C.

Also, an oil supply device 9 is provided in the vicinity of the fixing roll 21. The oil supply device 9 supplies a constant amount of a releasing agent on the surface of the fixing roll 21 from a tank 9*a* storing the releasing agent via a sponge-like sucking member 9*b* and rolls 9*c* and 9*d*. This prevents part of a toner 36 from being offset to the fixing roll 21 when an unfixed toner image formed using the toner 36 is fixed on paper 37. An example of a releasing agent supplied by the oil supply device 9 is dimethyl silicone oil having a viscosity of 1000 $mm^2/s$ (1000 cSt) (trade name: KF-96, manufactured by Shin-Etsu Chemical Co., Ltd.).

The pressure providing member 31 is formed by layering an elastic layer 31*b* and a low frictional layer 31*c* on the surface of a base plate 31*a*, and is pressed against the heat fixing roll 21 by a compression coil spring 26 disposed on the base plate 31*a* side. The base plate 31*a* is, for example, made of stainless steel to have a width (a running direction of the endless belt 25) of 20 mm, a length (a direction perpendicular to the running direction of the endless belt 25) of 320 mm, and a thickness of 5 mm. The elastic layer 31*b* is made of silicone sponge (a foam of silicone rubber) having a rubber hardness of 230 and has a thickness of 5 mm. The rubber hardness is measured using a sponge rubber hardness tester of an ASKER C type manufactured by Koubunshi Keiki Co., Ltd. by applying a load of 2.94 N (300 gf). Further, FGF-400-4 (trade name) manufactured by Chukoh Chemical Industries, Ltd., which is a glass fiber sheet impregnated with polytetrafluoroethylene, is used as the low frictional layer 31*c*.

Because the elastic layer 31*b* is provided, the contact surface of the low frictional layer 31*c* that comes in contact with the endless belt 25 can be matched with the outer peripheral surface of the heat fixing roll 21. That is to say, when the pressure providing member 31 is pressed against the fixing roll 21 by a load at or above a specific level, the elastic layer 31*b* undergoes deformation, which in turn causes the low frictional layer 31*c* to be deformed in such a manner that the contact surface is pressed against the heat fixing roll 21 along the outer peripheral surface thereof. Hence, when the pressure providing member 31 is pressed against the heat fixing roll 21 by the compression coil spring 26, the endless belt 25 is pressed against the fixing roll 21 without any clearance to form a belt nip portion.

Also, dimethyl silicone oil having a viscosity of 1000 $mm^2/s$ (1000 cSt) (trade name: KF-96, manufactured by Shin-Etsu Chemical Co., Ltd.) is applied on the surface of the low frictional layer 31*c*. This makes a coefficient of friction between the endless belt 25 and the pressure providing member 31 smaller. By applying dimethyl silicone oil, a coefficient of friction, $\mu 2$, between the pressure providing member 31 and the endless belt 25 is made smaller than a coefficient of friction, $\mu 1$, between the endless belt 25 and the heat fixing roll 21 ($\mu 1 > \mu 2$). When coefficients of friction on the both surfaces of the endless belt 25 are set in this manner, the endless belt 25 is allowed to move in association with rotations of the heat fixing roll 21 and thereby keeps running by sliding on the pressure providing member 31.

The endless belt 25 is made of, for example, a polyimide film to have a thickness of 75 μm, a width of 300 mm, and a peripheral length of 188 mm. The endless belt 25 is wound around the supporting rolls 22, 23, and 24 disposed at positions spaced apart from the heat fixing roll 21 at a tension of approximately 78.4 N (8 kgf). The supporting rolls 22, 23, and 24 are made of stainless and their diameters are 18 mm, 18 mm, and 23 mm, respectively.

The endless belt 25 is pressed against the heat fixing roll 21 without any clearance as the pressure providing member 31 is pressed against the heat fixing roll 21. In this instance, a contact pressure of the pressure providing member 31 is set to be approximately $5.5\times10^4$ Pa (0.56 kgf/cm$^2$). Also, the heat fixing roll 21 is rotated by the motor 38 in a direction indicated by an arrow C at a peripheral velocity V=220 mm/sec. The endless belt 25 is also rotated at a velocity of 220 mm/sec. in association with the rotations of the heat fixing roll 21.

Operations of the fixing device of this example will now be described. In the fixing device of this example, a toner image formed using the toner 36 is transferred onto the surface of the paper 37 by an unillustrated transferring device on the right of FIG. 3, and the paper 37 is conveyed toward the belt nip portion. The paper 37 enters into the belt nip portion at a position at which the pressure providing member 31 is disposed. The toner image 36 is then fixed onto the surface of the paper 37 by a pressure acting on the belt nip portion and heat from the halogen lamp 35 transmitted via the heat fixing roll 21.

Figure 4:
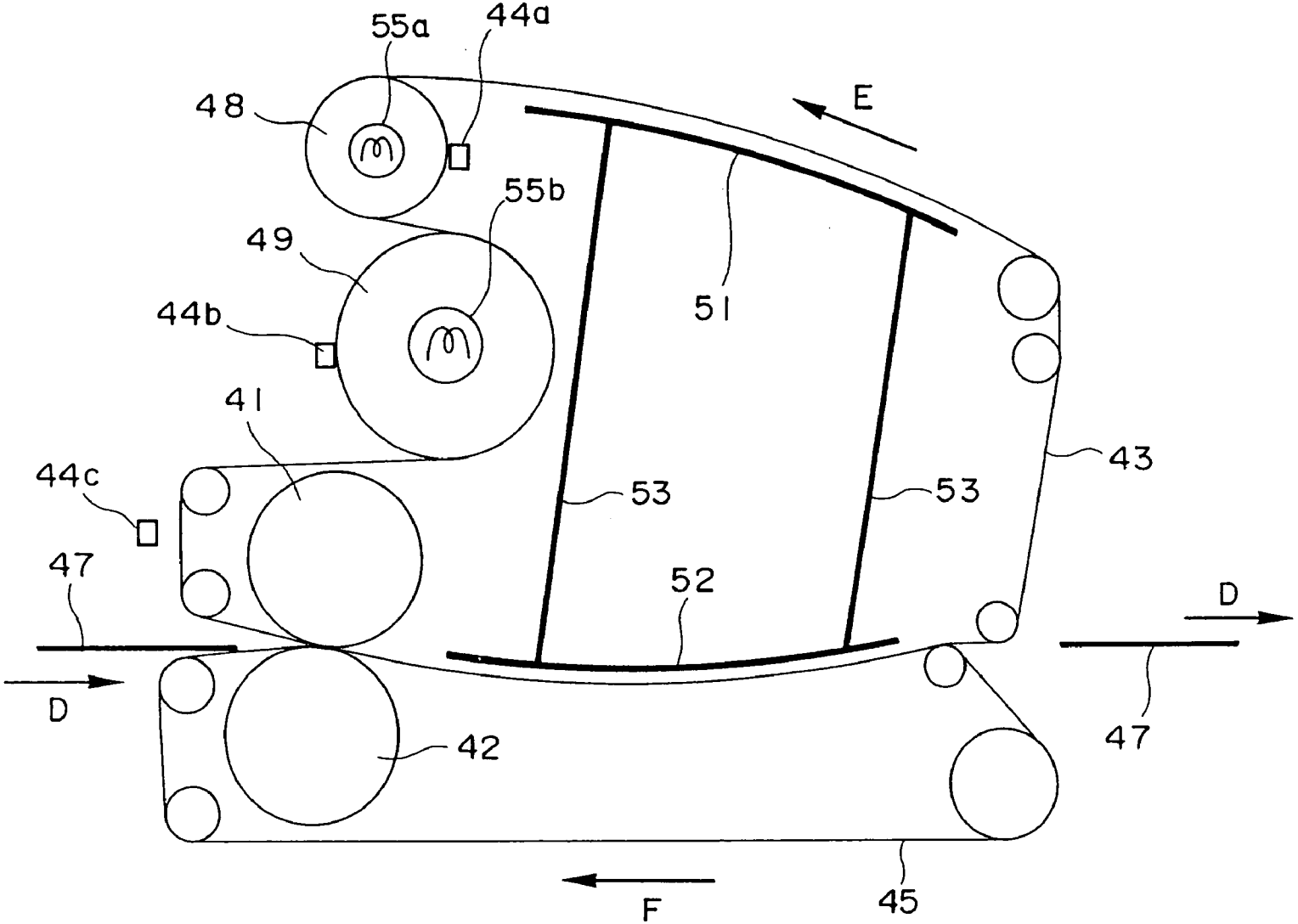
FIG. 4 is a view schematically showing the configuration of still another example of a fixing device used in the image forming method of the invention.

An example of a belt-belt nip-type fixing device (fixing device III) will now be described in detail. The fixing device of this example is the one whose configuration is schematically shown in FIG. 4.

In the fixing device of this example, a fixing belt 43 that circulates in a direction indicated by an arrow E and a pressurizing belt 45 that circulates in a direction indicated by an arrow F in association with the fixing belt 43 are pressed against each other and thereby form a fixing nip portion. An inlet of the nip portion is formed at an insertion position of paper 47 as the fixing belt 43 and the pressurizing belt 45 are pressed from the inner periphery to oppose each other by a pressurizing roll 41 and a pressurizing roll 42, respectively. The surface of the fixing belt 43 is heated satisfactorily by three heating portions, including first, second, and third heating portions, until it reaches the nip portion.

The first heating portion is configured to heat the fixing belt 43 by transferring heat, absorbed from the fixing belt 43 by a cooling plate 52 provided to cool the fixing belt 43 in a cooling portion located in downstream from the inlet of the nip portion, to an aluminum heating plate 51 via a heat pipe 53.

The second heating portion comprises an aluminum heating roll 48 that comes in contact with the back surface (the inner peripheral surface) of the fixing belt 43. A heater 55*a* is provided in the interior of the heating roll 48, and a temperature thereof is controlled by an unillustrated temperature controller according to detection data from a temperature sensor 44*a* provided to detect a surface temperature of the heating roll 48.

The third heating portion comprises an aluminum heating roll 49 that comes in contact with the surface (outer peripheral surface) of the fixing belt 43. A heater 55*b* is provided in the interior of the heating roll 49, and a temperature thereof is controlled by an unillustrated temperature controller according to detection data from a temperature sensor 44*b* provided to detect a surface temperature of the heating roll 49.

The fixing belt 43 is pre-heated by the first heating portion, heated from the back surface side by the second heating portion, and heated from the surface side by the third heating portion successively as it circulates in a direction indicated by an arrow E, so that it is heated to a temperature high enough for the fixing by the time it reaches the nip portion. A temperature sensor 44*c* that detects a surface temperature of the fixing belt 43 is disposed immediately before the nip portion, and heating conditions for the second heating portion or the third heating portion or for the both are controlled by an unillustrated controller by feedback based on detection data.

Paper 47, on which an unfixed toner image is formed, moves in a direction indicated by an arrow D, and when it is inserted into the inlet of the nip portion formed between the fixing belt 43 and the pressurizing belt 45 by disposing the pressurizing roll 41 and the pressurizing roll 42 to oppose each other, heat and a pressure are applied to the paper 47; and the toner forming the toner image melts. While the toner remains in a melted state, it serves as an adhesive, so that the fixing belt 43 and the paper 47 are brought into a bonded state. When heat is absorbed from the fixing belt 43 by the cooling plate 52 in the cooling portion later, the absorbed heat is utilized in the first heating portion as described above. Then, the fixing belt 43 is cooled in the cooling portion, so that a temperature of the fixing belt 43 in a separating portion, corresponding to an outlet of an interval (nip portion) over which the fixing belt 43 and the pressurizing belt 45 keep abutting on each other, is at or below a temperature at which the toner is solidified to some extent to have a viscosity such that makes it easy for the toner to be separated from the fixing belt 43. The paper 47 is thus separated from the fixing belt 43 in the separating portion, and moves in a direction indicated by an arrow D to be discharged to the outside of the apparatus.

In this example, the fixing belt 43 is cooled in the cooling portion so that the surface temperature is 100° C. or below. However, it is more preferable to regulate the temperature to be 90° C. or below.

In addition, the surface of the fixing belt 43 is heated by the three heating portions so that a surface temperature is as high as or higher than a melting temperature of the toner at the inlet of the nip portion. In this example, the fixing belt 43 is heated so that the surface temperature reaches 175° C. To be more specific, it is preferable to heat the fixing belt 43 by the first heating portion, the second heating portion, and the third heating portion, so that the surface temperature is raised to be in the range of 115 to 120° C., in the range of 160 to 170° C., and approximately 175° C., respectively.

In the fixing device of this example, because the fixing belt 43 is heated forcefully with the three heating portions as described above, heating efficiency is so high that fast fixing can be achieved. Because heat in the paper 47 and the fixing belt 43 that need to be cooled after the fixing is moved to the first heating portion for reuse, not only the sheet separation property but also heat efficiency is satisfactory.

The configuration as described above enables this example to achieve successive fast fixing at a rate, for example, 60 sheets per min. (by feeding A4-size sheets in landscape orientation).

One preferred example of a process of fixing the toner image in the image forming method of the invention includes passing paper, on which an unfixed toner image is formed, through a nip portion, formed by a heated fixing roll and a press-bonding roll that are pressed against each other, in such a manner that a toner image carrying surface faces the fixing roll side, to heat and press-bond the unfixed toner image.

Another preferred example of a process of fixing the toner image in the image forming method of the invention includes passing paper, on which an unfixed toner image is formed, through a nip portion, formed by a heated fixing roll and an endless belt that abuts an outer peripheral surface of the fixing roll, in such a manner that a toner image carrying surface faces the fixing roll side, to heat and press-bond the unfixed toner image.

Still another preferred example of a process of fixing the toner image in the image forming method of the invention includes passing paper, on which an unfixed toner image is formed, through a nip portion, formed by a heated fixing belt and a pressurizing belt that are pressed against each other, in such a manner that a toner image carrying surface faces the fixing belt side, to heat and press-bond the unfixed toner image; moving the fixing belt and the paper carrying a fixed toner image on a surface thereof while maintaining close contact to each other; and separating the paper carrying the fixed toner image on the surface thereof from the fixing belt after the toner image is cooled to or below a predetermined temperature.

In the invention, the fixing can be performed by a non-contact method by applying at least light energy to paper on which an unfixed toner image is formed (hereinafter, this method is occasionally referred to as "optical fixing"). It is preferable to perform the fixing by such a non-contact method from the viewpoint of achieving the fast fixing such that the speed of the apparatus can be increased (an increase of the output number of image-carrying sheets per minute).

Light energy (fixing energy) in optical fixing is preferably in the range of about 1 to 7 J/cm$^2$, and more preferably, in the range of about 2 to 5 J/cm$^2$. To be more specific, in a case where color toner images of respective colors are transferred onto a recording material image by image and optical fixing is performed image by image (monochrome optical fixing), preferable light energy is of the order of 1 to 3 J/cm$^2$. In a case where layered color toner images of four or more colors are transferred onto a recording material altogether at a time and optical fixing is performed (collective optical fixing for four or more colors), preferable light energy is of the order of 2 to 7 J/cm$^2$, and more preferable light energy is in the range of about 3 to 5 J/cm$^2$.

An optical fixer used in the optical fixing can be a light source (lamp) capable of irradiating infrared rays in the near-infrared region, such as a mercury lamp, a halogen lamp, or a xenon lamp, and one or two or more lamps can be used.

Of these lamps, it is preferable to use a xenon lamp as the light source, because the light absorption efficiency in the near-infrared region of an infrared absorbent used in the invention can be improved more effectively and a satisfactory fixing property can be therefore achieved.

While an image forming apparatus and fixing devices that can be used in the image forming method of the invention have been described by using various fixing devices, the invention is not limited to these apparatus and devices, and known image forming apparatus and fixing devices of various kinds can be used as well. Also, individual components described in each example above can be also used in another example.

In the invention, it is preferable that, in the process of fixing the toner image, a value obtained by dividing a distance in the moving direction of paper within the heating region by a moving velocity of the paper is in the range of about 0.2 millisececonds to 2 seconds. The heating region referred to herein means a region where the fixing roll or the fixing belt can heat paper for the contact-type heat fixing device, and a region where light energy can heat paper for the non-contact type heat fixing device. Hence, a distance in the moving direction of a sheet of paper within the heating region for the contact-type means, for example, a nip width between two rolls, and a distance in the moving direction of paper for the non-contact type means, for example, a length in the moving direction of an exposed portion by the optical fixer.

The value obtained by dividing a distance in the moving direction of paper within the heating region by a moving velocity of the paper means a time (dwell time) needed for a given part of paper to pass by the heating region, which is preferably in the range specified above.

The dwell time is more preferably in the range of about 0.4 milliseconds to 1.9 seconds. When the dwell time is shorter than 0.2 milliseconds, fixing cannot be performed satisfactorily, in particular, in a case where a toner amount of the unfixed toner image is large. Conversely, when the dwell time exceeds 2 seconds, blisters may readily occur in a case where a bulk density of toner is low.

Also, in the image forming method of the invention, it is possible to heat in advance (pre-heat) paper, on which an unfixed toner image is formed, so that a temperature on the toner image carrying side is heated to about 50° C. or above, after the unfixed image is formed on the paper and before the paper is introduced into the fixing device. When the surface of paper is pre-heated to about 50° C. or above, water held inside the paper turns into moisture vapor and is brought into a state that readily induces molecular motions. The water content is thus reduced, which makes it easier for moisture vapor to be released from the paper during the process of fixing the toner image. This particularly prevents the occurrence of blisters.

It should be noted, however, that when the toner forming an unfixed image is melted by pre-heating, the resulting image may be adversely affected. It is thus preferable to perform the pre-heating at or below a melting temperature of the toner used. Further, the pre-heating temperature is set preferably at least 10° C. lower, and more preferably, at least 20° C. lower than the melting temperature of the toner used.

The pre-heating method can be either a non-contact method using radiation heat or a method using heat conduction to heat paper by contact. In either method, however, it is necessary to raise a temperature on the surface of paper to 50° C. or above at an outlet of the pre-heating device that performs pre-heating. A method of measuring a temperature on the surface of paper can be either a contact method using a thermocouple, or a non-contact method, such as an infrared irradiation method.

One example of a pre-heating device that can be used when the pre-heating is performed in the image forming method of the invention will now be described below. It should be appreciated, however, that a pre-heating device that can be used in the invention is not limited to the example below. The pre-heating device can be set either upstream or downstream of the process of transferring the toner image. However, it goes without saying that it should be set upstream in the process of fixing the toner image.

Figure 5:
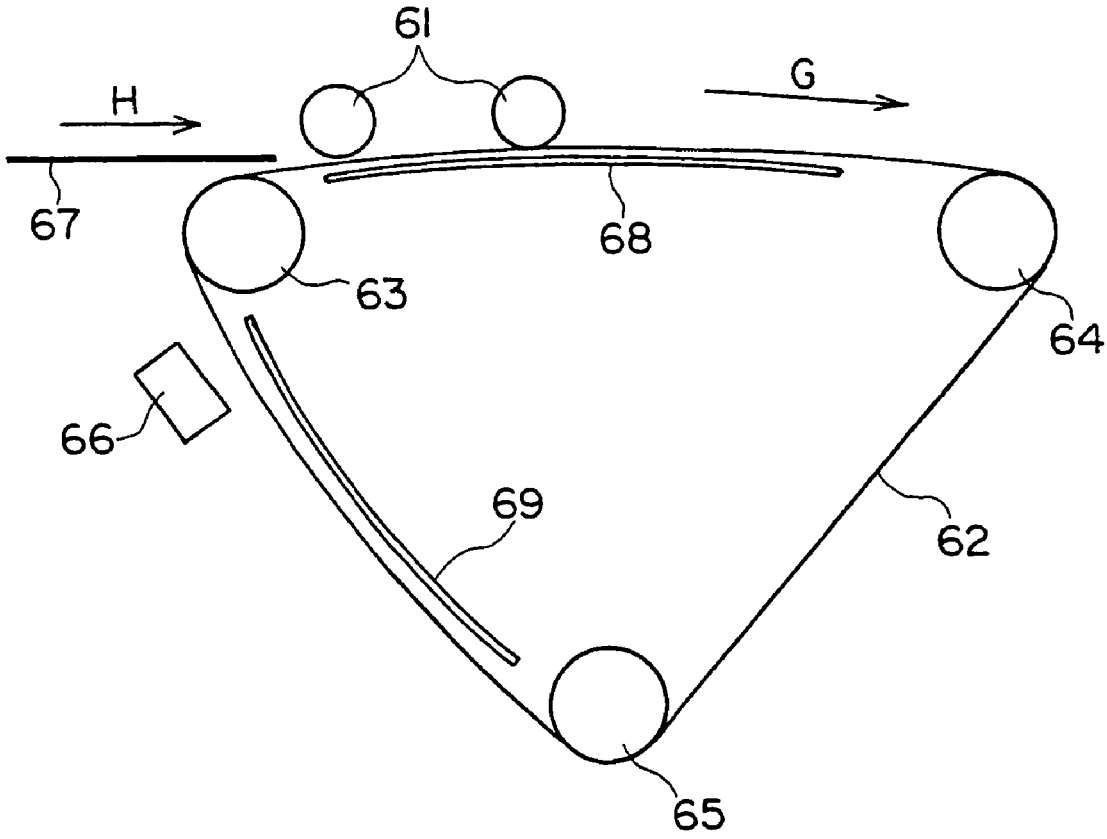
FIG. 5 is a view schematically showing the configuration of one example of a pre-heating device used in the image forming apparatus of the invention.

FIG. 5 is a view schematically showing the configuration of one example of the pre-heating device that can be used when the pre-heating is performed in the image forming method of the invention.

The pre-heating device of this example chiefly comprises a heating roll 63, a heating belt 62 stretched over a driving roll 64 and a stretching roll 65 and driven to rotate in a direction indicated by an arrow G by a driving force of the stretching roll 65, two pressing rolls 61 and a charger 66 disposed on the outer periphery of the heating belt 62, and a counter plate 68 and a heating plate 69 disposed on the inner periphery of the heating belt 62.

The heating plate 69 and the heating roll 63 are configured to heat the heating belt 62 from the inner periphery by unillustrated heat sources housed therein. The heating plate 69 uses radiation heat and is therefore in a non-contact state with respect to the heating belt 62, whereas it goes without saying that the heating roll 63 comes in contact with the heating belt 62 and confers heat to the heating belt 62. The pressing rolls 61 and the counter plate 68 abut on each other via the heating belt 62, and a nip portion is formed in between. The heating belt 62 rotates in a direction indicated by an arrow G and by the time it reaches the nip portion, the surface of the heating belt 62 has reached a temperature sufficiently high for the pre-heating due to the heating by the heating plate 69 and the heating roll 63. Although it is not shown in the drawing, the counter plate 68 includes a sub-heat source.

Also, the charger 66 is disposed upstream from the nip portion formed by the pressing rolls 61 and the counter plate 68 in a rotating direction (a direction indicated by an arrow G) of the heating belt 62. A corotron charger is used as the charger 66, and it serves a function of improving the conveyance performance by charging the surface of the heating belt 62 to allow a sheet of paper 67, on the surface of which an unfixed toner image is formed, to be attracted to the surface of the heating belt 62 in close adhesion.

When the sheet of paper 67, on the surface of which an unfixed toner image was formed in the preceding process, is sent to the pre-heating device of this example, it moves in a direction indicated by an arrow H and is inserted into the nip portion formed by the pressing rolls 61 and the counter plate 68, in such a manner that the unfixed toner image carrying surface faces the pressing rolls 61 side (the unfixed toner image carrying surface faces up in the drawing). When passing through the nip portion, the paper 67 is heated by the heating belt 62 that has been previously heated to a predetermined temperature by the heating plate 69 and the heating roll 63 to remove moisture. Heat held by the heating belt 62 in this instance is maintained by the sub-heat source included in the counter plate 68.

The paper 67 is then conveyed in a direction indicated by an arrow G while it is closely attracted to the heating belt 62, and is pre-heated satisfactorily (that is, the toner image carrying surface is heated to about 50° C. or above) while it is conveyed. In the meantime, a self-stripping property is conferred from the driving roll 64 due to an influence of the radius of curvature of the heating belt 62, and the paper 67 is thereby separated from the surface of the heating belt 62. The paper 67 is then sent to the process of fixing the toner image performed by the fixing device.

As has been described, it is possible by the invention to form an image having an increased toner amount of unfixed toner images without causing image roughness or blisters by specifying a range of bulk density of toner.

EXAMPLES

The invention will now be described more concretely by way of examples. It should be appreciated, however, that the invention is not limited to examples below. In the examples, "part(s)" and "%" mean, respectively, "part(s) by mass" and "% by mass" unless specified otherwise.

Paper used in examples and comparative examples below will be described first.

A characteristic evaluation method for each kind of paper is as follows.

(1) Basis Weight

The basis weight is measured by a method in accordance with JIS P-8124.

(2) Sheet Glossiness

Sheet glossiness is measured at an angle of incidence of 75° in accordance with JIS P-8142, the disclosure of which is incorporated by reference herein.

(3) Air Permeability

Air permeability is measured by a method in accordance with J TAPPI Paper and Pulp Test Method No. 5 (air permeability measured by the Oken method air permeability test).

(4) Smoothness

Smoothness is measured by a method in accordance with J TAPPI Paper and Pulp Test Method No. 5 (smoothness measured by the Ohken method smoothness test), using an Oken-method digital display air permeability and smoothness tester (Model type: EY), manufactured by Asahi Seiko Co., Ltd.

(Manufacturing of Paper)

(Paper I)

Pulp slurry prepared by blending 80 parts by mass of LBKP (hardwood bleached kraft pulp) and 20 parts by mass of NBKP (softwood bleached kraft pulp) is beaten by a Niagara beater (manufactured by Kumagai Riki Kogyo Co., Ltd.) to obtain pulp slurry having a freeness of 500 ml. Then, 10 parts by mass of calcium carbonate light (trade name: Tama Pearl TP-121, manufactured by Okutama Kogyo Co., Ltd.), 0.2 part by mass of cationized starch (trade name: MS4600, manufactured by Nihon Shokuhin Kako Co. Ltd.), and 0.05 part by mass of alkenyl succinic anhydride (FIBRAN 81, manufactured by Oji National Co., Ltd.), per 100 parts by mass of pulp are added to the resulting pulp slurry. The resulting mixture is diluted with white water to prepare stock slurry having a solid content concentration of 0.3%.

The resulting stock slurry is stirred for two hours, and made into paper using an oriented sheet former (manufactured by Kumagai Riki Kogyo Co., Ltd.). Then, the resulting wet paper is coated with sodium polyacrylate (Sanfresh ST 500MPSA, manufactured by Sanyo Chemical Industries, Ltd.) using a size press machine, so that a coating amount in dry mass is 3.0 g/m$^2$. Then the wet paper is dried, followed by smoothing treatment using a machine calendar, so that the smoothness measured by the Oken method smoothness test is 500 sec. A base material having a basis weight of 84 g/m$^2$ is thus obtained.

The air permeability of the base material thus obtained is 5000 (seconds).

Meanwhile, a coating composition to be coated on the resulting base material is prepared by mixing 3 parts (an amount ratio of solid contents with respect to 100 parts of pigment components, the same applies hereinafter) of oxidized starch used as an adhesive (Ace A, manufactured by Oji Cornstarch Co., Ltd.), 14 parts of a synthetic adhesive (a mixture of LX 430 and 2507H (both manufactured by Zeon Corporation) at a mixing ratio of 20:80), and 0.3 part of a dispersing agent (ARON T-40, manufactured by Toagosei Co., Ltd.). The pigment components are prepared by blending 20% of calcium carbonate light (trade name: Tama Pearl T-123, manufactured by Okutama Kogyo Co., Ltd.) and 80% of kaolin (trade name: Ultrawhite 90, manufactured by Engelhard Corporation).

The resulting coating composition is coated on both surfaces of the base material using a blade coater, so that a dry mass on each surface is 10 g/m$^2$. Then the base material coated with the coating composition is dried, followed by smoothing treatment using a supercalendar having a roll temperature of 50° C., so that sheet glossiness is 50%. Paper I, as a coated paper having a basis weight of 104 g/m$^2$, is thus obtained.

(Paper II)

Stock slurry having a sold content concentration of 0.3% is prepared in the same manner as paper I. The resulting stock slurry is stirred for two hours, and then made into paper using an oriented sheet former (manufactured by Kumagai Riki Kogyo Co., Ltd.). Then, the resulting wet paper is coated with starch-acrylic acid graft copolymer (Sanwet, manufactured by Sanyo Chemical Industries, Ltd.) using a size press machine, so that a coating amount in dry mass is 3.5 g/m$^2$. Then the wet paper is dried, followed by smoothing treatment using a machine calendar, so that the smoothness measured by the Oken method smoothness test is 550 sec. A base material having a basis weight of 94 g/m$^2$ is thus obtained.

The air permeability of the base material thus obtained is 2000 sec.

Meanwhile, a coating composition to be coated on the resulting base material is prepared by mixing 3 parts (an amount ratio of solid contents with respect to 100 parts of pigment components, the same applies hereinafter) of oxidized starch used as a adhesive (Ace A, manufactured by Oji Cornstarch Co., Ltd.), 14 parts of a synthetic adhesive (a mixture of 0623A and 0640 (both manufactured by JSR Corporation) at a mixing ratio of 15:85), and 0.2 part of a dispersing agent (ARON T-40, manufactured by Toagosei Co., Ltd.). The pigment components are prepared by blending 40% of calcium carbonate light (trade name: Tama Pearl T-123, manufactured by Okutama Kogyo Co., Ltd.), 50% of kaolin (trade name: Ultrawhite 90, manufactured by Engelhard Corporation), and 10% of an organic pigment (NIPOL MH5055, manufactured by Zeon Corporation).

The resulting coating composition is coated on both surfaces of the base material using a blade coater, so that a dry mass on each surface is 5 g/m$^2$. Then the base material is dried, followed by smoothing treatment using a supercalendar having a roll temperature of 50° C., so that sheet glossiness is 30%. Paper II, as a coated paper having a basis weight of 104 g/m$^2$, is thus obtained.

(Paper III)

Stock slurry having a sold content concentration of 0.3% is prepared in the same manner as paper I. The resulting stock slurry is stirred for two hours, and then made into paper using an oriented sheet former (manufactured by Kumagai Riki Kogyo Co., Ltd.). Then, the resulting wet paper is coated with an acrylic acid-vinyl alcohol copolymer (SUMIKAGEL, manufactured by Sumitomo Chemical Co., Ltd.) using a size press machine, so that a coating amount is 2.5 g/m$^2$. Then the wet paper is dried, followed by smoothing treatment using a machine calendar, so that the smoothness measured by the Oken method smoothness test is 600 sec. A base material having a basis weight of 84 g/m$^2$ is thus obtained.

The air permeability of the base material thus obtained is 8000 sec.

Thereafter, a coating layer is formed in the same manner as paper I, and paper III, as a coated paper having a basis weight of 104 g/m$^2$, is obtained.

(Paper IV)

Paper IV, as a coated paper having a basis weight of 104 g/m$^2$, is obtained in the same manner as paper I, except that coating of sodium polyacrylate by the size press machine is omitted when the base material is manufactured.

The smoothness and the air permeability of the base material of paper IV are 700 sec. and 8000 sec., respectively.

(Paper V)

Commercially available printing coated paper, OK Top Coat N (basis weight: 104.7 g/m$^2$, manufactured by Oji Paper Co., Ltd.), is used as paper V.

The smoothness and the air permeability of the base material of paper V are 200 sec. and 2000 sec., respectively.

Characteristics of these kinds of paper, including those specified above, are set forth in Table 1 below.

TABLE 1

| Paper No. | Base Material: Smoothness | Base Material: Air Permeability | Coating Amount of Coating Layer (g/m$^2$) (surface/back surface) | Sheet Glossiness (%) | Basis Weight (g/m$^2$) |
|---|---|---|---|---|---|
| I | 500 | 5000 | 10/10 | 50 | 104 |
| II | 550 | 2000 | 5/5 | 30 | 104 |
| III | 600 | 8000 | 10/10 | 60 | 104 |
| IV | 700 | 8000 | 10/10 | 65 | 104 |
| V | 200 | 2000 | 5/5 | 30 | 104.7 |

(Manufacturing of Toner and Developer)

A property evaluation method when resin particle dispersions are prepared as below will be described first.

(Measuring Method of Molecular Weight and Molecular Weight Distribution of Toner and Resin Particles)

A molecular weight and a molecular weight distribution of a toner and resin particles in the invention are measured using gel permeation chromatography (GPC). For GPC, HLC-8120GPC and SC-8020 (manufactured by Tosoh Corporation) are used. Also, two columns, TSKgel SuperHM-H (6.0 mm ID×15 cm, manufactured by Tosoh Corporation), are used, and THF (tetrahydrofuran) is used as an eluent. An experiment is conducted using an IR detector under the experimental conditions that a sample concentration is 0.5% by mass, a flow velocity is 0.6 ml/min., a sample injection amount is 10 μl, and a measuring temperature is 40° C. A working curve is prepared from 10 samples of polystylene standard reference materials, TSK standard: A-500, F-1, F-10, F-80, F-380, A-2500, F-4, F-40, F-128, and F-700, manufactured by Tosoh Corporation. Data acquisition intervals for sample analysis are 300 ms.

(Volume Average Particle Size of Resin Particles, Coloring Agent Particles, and Releasing Agent Particles)

The volume average particle sizes of the resin particles, the coloring agent particles, and releasing agent particles are measured by a laser scattering particle size distribution analyzer (LA-7000, manufactured by Horiba, Ltd).

(Glass Transition Points of Toner and Resin Particles, and Melting Point of Releasing Agent)

Glass transition points of toner and resin particles, and a melting point of the releasing agent are determined by measurement using a differential scanning calorimeter (DSC-50, manufactured by Shimadzu Corporation) under the condition that a rate of temperature rise is 10° C./min. Herein, the glass transition point is defined as a temperature at a crossing point of the base line and an extension of a rising line in the heat absorption portion, and a melting point is defined as a temperature at the top of a heat absorption peak.

Toners and developers used in examples and comparative examples will now be described.

(Preparation of Various Dispersions)

Preparation of Resin Particle Dispersion

A solution is prepared by blending and dissolving components as follows:

| | |
|---|---|
| styrene | 480 parts |
| n-butylacrylate | 120 parts |
| acrylic acid | 8 parts |
| dodecanethiol | 16 parts |

Meanwhile, 12 parts of an anionic surfactant (DOWFAX, manufactured by the Dow Chemical Corporation) is dissolved in 250 parts of ion exchanged water, to which the solution prepared earlier is added to be dispersed and emulsified in a flask (monomer emulsion liquid A). Further, 1 part of an anionic surfactant (DOWFAX, manufactured by the Dow Chemical Corporation) is dissolved in 555 parts of ion exchanged water, which is then placed in a polymerization flask.

The polymerization flask is sealed hermetically and a reflux tube is provided. Then, the polymerization flask is heated in a water bath and kept at 75° C. while being agitated gently with nitrogen being injected. A solution, prepared by dissolving 9 parts of ammonium persulfate in 43 parts of ion exchanged water, is dropped into the polymerization flask in 20 min. via a metering pump. Thereafter, the monomer emulsion liquid A is dropped into the polymerization flask in 200 min. via the metering pump. Then the polymerization flask is kept at 75° C. for three hours while being kept agitated gently to complete polymerization.

An anionic resin particle dispersion, in which particles have a volume average particle size of 190 nm, the glass transition point at 50° C., a weight average molecular weight of 19000, and a solid content amount of 42%, is thus obtained.

Preparation of Coloring Agent Particle Dispersion (1)

A solution is prepared by blending and dissolving components as follows:

| | |
|---|---|
| yellow pigment (PV74, manufactured by Clariant Japan) | 50 parts |
| anionic surfactant (NEOGEN R, manufactured by Dai-ichi Kogyo Seiyaku Co., Ltd.) | 5 parts |
| ion exchanged water | 200 parts |

The resulting solution is dispersed for 10 min. using a homogenizer (ULTRATURRAX T50, manufactured by IKA) to obtain a yellow coloring agent particle dispersion (1), in which particles have a volume average particle size of 200 nm and a solid content amount of 21.5%.

Preparation of Coloring Agent Particle Dispersion (2)

A cyan coloring agent particle dispersion (2), in which particles have a volume average particle size of 190 nm and a solid content amount of 21.5%, is obtained in the same manner as preparation of the coloring agent particle dispersion (1), except that a cyan pigment (Copper Phthalocyanine B15:3, manufactured by Dainichiseika Color and Chemicals Mfg. Co., Ltd.) is used instead of the yellow pigment used in the preparation of the coloring agent particle dispersion (1).

Preparation of Coloring Agent Particle Dispersion (3)

A magenta coloring agent particle dispersion (3), in which particles have a volume average particle size of 160 nm and a solid content amount of 21.5%, is obtained in the same manner as preparation of the coloring agent particle dispersion (1), except that a magenta pigment (Pigment Red 122, manufactured by Dainippon Ink and Chemicals, Inc.) is used instead of the yellow pigment used in the preparation of the coloring agent particle dispersion (1).

Preparation of Coloring Agent Particle Dispersion (4)

A black coloring agent particle dispersion (4), in which particles have a volume average particle size of 170 nm and a solid content amount of 21.5%, is obtained in the same manner as preparation of the coloring agent particle dispersion (1), except that a black pigment (carbon black, manufactured by Cabot Corporation) is used instead of the yellow pigment used in the preparation of the coloring agent particle dispersion (1).

Preparation of Releasing Agent Particle Dispersion

Components specified below are heated to 110° C. and dispersed satisfactorily using a homogenizer (ULTRATURRAX T50, manufactured by IKA), followed by dispersion treatment using a pressure releasing homogenizer (Gaulin homogenizer, manufactured by APV Gaulin Inc.):

| | |
|---|---|
| paraffin wax (HNP-9, manufactured by Nippon Seiro Co., Ltd., melting point: 75° C.) | 50 parts |
| anionic surfactant (DOWFAX, manufactured by the Dow Chemical Company) | 5 parts |
| ion exchanged water | 200 parts |

A releasing agent particle dispersion, in which particles have a volume average particle size of 115 nm and a solid content amount of 21.0%, is thus obtained (Manufacturing of Toner Particles 1)

Components specified below are blended and dispersed satisfactorily in a round stainless flask, using a homogenizer (ULTRATURRAX T-50, manufactured by IKA):

| | |
|---|---|
| resin particle dispersion | 126.05 parts (resin content: 52.94 parts) |
| coloring agent particle dispersion (1) | 39.5 parts (pigment content: 8.5 parts) |
| releasing agent particle dispersion | 38.1 parts (releasing agent content: 10 parts) |
| polyaluminum chloride | 0.13 part |

Thereafter, the flask is heated to 43° C. in a heating oil bath while being agitated, and kept at 48° C. for 50 min. Then, 68 parts (resin content: 28.56 parts) of the resin particle dispersion is added followed by gentle stirring. Subsequently, the temperature of the system in the flask rises and is kept at 45° C. for 100 min. to confirm that the particle size distribution becomes narrower, using a COULTER COUNTER TA-II (available from Nikkaki Co., Ltd.).

After a pH in the system is adjusted to be 6.5 using 0.5 mol/l of a sodium hydroxide solution, the system is heated to 95° C. with stirring. While the temperature rises to 95° C., a pH in the system drops to 5.3, which is, however, maintained.

After the reaction completes, the system is cooled and filtered, and rinsed with ion exchanged water satisfactorily, after which it is subjected to solid-liquid separation by Nutsche suction filtration. The resulting solid content is dispersed again in 3 liters of ion exchanged water at 40° C., and the resulting solution is kept stirred at 300 rpm for 15 min. and then rinsed. This rinsing operation is repeated five times, and the resulting system is subjected to Nutsche suction filtration. The resulting content is vacuum dried for 12 hours to obtain yellow toner particles 1.

When the particle size of the toner particles 1 is measured by a COULTER COUNTER TA-II (available from Nikkaki Co., Ltd.), a volume average particle size and a volume average particle size distribution index GSDv are found to be 3.5 μm and 1.20, respectively. Also, the shape observation using a LUZEX reveals that the toner particles 1 are of a spherical shape having the shape factor SF1 of 120.

(Manufacturing of Developer Set 1)

A toner 1 is obtained by adding 1.6 parts of hydrophobic silica (TS720, manufactured by Cabot Corporation) to 50 parts of the toner particles 1, followed by blending using a sample mil. A bulk density of the toner 1 is 0.5 g/cm$^3$. The toner is then weighed so that a toner concentration is 5% using a ferrite carrier coated with 1% of polymethylmethacrylate (manufactured by Sohken Chemical & Engineering Co., Ltd.) and having a volume average particle size of 50 μm, and the both are stirred and blended for 5 min. using a ball mil to manufacture a developer having a releasing agent mixed amount of 10% and containing a yellow toner having a volume average particle size of 3.5 μm.

Cyan toner particles, magenta toner particles, and black toner particles, each having the same volume average particle size and shape factor as those of the toner particles 1, are obtained in the same manner as the manufacturing of the toner particles 1 except that the coloring agent particle dispersion (1) is replaced with coloring agent particle dispersions (2) through (4), respectively. Three kinds of developers of respective colors are obtained by treating these particles with hydrophobic silica in the same manner as above and blending them with the carrier in the same manner as above.

Four kinds of developers containing toners of respective colors of yellow, cyan, magenta, and black, are referred to as a developer set 1.

(Manufacturing of Toners 2 through 6, and Developer Sets 2 through 6)

Yellow toners 2 through 6 are manufactured in the same manner as the manufacturing of the toner particles 1, except that the shape factor SF1 is changed to within the range of 125 to 140 and the bulk density of toner is changed to 0.4 g/cm$^3$, 0.3 g/cm$^3$, 0.2 g/cm$^3$, 0.15 g/cm$^3$, and 0.55 g/cm$^3$, by changing a manufacturing temperature of aggregated particles and a coalescence temperature. Also, cyan, magenta, and black toners (5 sets) having the same bulk densities as those of the yellow toners 2 to 6, respectively, are manufactured by changing a coloring agent alone in the respective yellow toners.

Sets of developers including the four colors is manufactured using the toners described above in the same manner as above. Five developer sets 2 through 6, each having a different bulk density of toner, are thus manufactured.

(Evaluation Apparatus)

(Image Forming Apparatus I)

The fixing device I shown in FIG. 2 is housed in the image forming apparatus shown in FIG. 1, and developing units for the four colors are loaded with the respective developer sets. The apparatus configured in this manner is referred to as an image forming apparatus I. In this apparatus, a process speed is 166 mm/sec., and a fixing temperature is 175° C.

(Image Forming Apparatus II)

The fixing device II shown in FIG. 3 is housed in the image forming apparatus shown in FIG. 1, and developing units for the four colors are loaded with the respective developer sets. The apparatus configured in this manner is referred to as an image forming apparatus II. In this apparatus, a process speed is 100 mm/sec., and a fixing temperature is 160° C.

(Image Forming Apparatus III)

The fixing device III shown in FIG. 4 is housed in the image forming apparatus shown in FIG. 1, and developing units for the four colors are filled with the respective developer sets. The apparatus configured in this manner is referred to as an image forming apparatus III. In this apparatus, a process speed is 266 mm/sec., and a fixing temperature is 150° C.

(Paper Heating Mechanism)

In the image forming apparatus I shown in FIG. 1, the pre-heating device shown in FIG. 5 is located downstream from a transferring portion formed by the spindle roll 18*c* and the transfer roll 19 and upstream from the fixing device I chiefly comprising the fixing roll 1 and the press-bonding roll 2 as is shown FIG. 2. Also, a paper surface temperature measuring device (an infrared radiometer, manufactured by Keyence Corporation) is provided immediately after the pre-heating device, so that a temperature on the surface of a transfer material (a sheet of paper) 7 is 120° C.

EXAMPLES 1 THROUGH 4 AND COMPARATIVE EXAMPLES 1 THROUGH 4

Examples 1 through 4 and Comparative Examples 1 through 4 are conducted by combining the developer sets 1 through 6, the papers I through V, and the image forming apparatuses I through III as set forth in Table 2 below. In each example, the apparatus is set to a monochrome mode to print one color, cyan, alone, and various images are printed while changing TMA to within the range of 1.5 to 5.0 g/cm$^2$ by adjusting a developing bias. The images are evaluated on the points specified below.

In Example 4, evaluation is made by providing the pre-heating device to the image forming apparatus I.

(Evaluation on Image Roughness)

Evaluation is made on a character image, a fine line image, and a half-tone image according to criteria as follows.

Character Quality

Herein, 3-point alphabets "Xerox" and 6-point complicated structured Japanese characters are enlarged for observation, using a digital microscope (manufactured by Keyence Corporation), and the sharpness (definition) in the edge portion and toner scattering (character scattering) in the vicinity of the edge portion are evaluated according the criteria as follows.

A: sharpness is quite excellent in the edge portion and the tip end of characters without any character scattering.

B: sharpness is satisfactory without any character scattering.

C: sharpness is poor with noticeable character scatterings.

Acceptance criteria are the criterion A and the criterion B.

Fine Line Reproducibility

An image of a fine line having a line width of 50 μm is formed on the photoreceptor, which is transferred and fixed on a sheet of paper. The image of a fine line on the fixed image is enlarged by 175 times for observation, using a VH-6200 micro hiscope (manufactured by Keyence Corporation). Concrete evaluation criteria are as follows, and the acceptance criterion is the criterion A.

A: a fine line is filled with the toner evenly without any roughness in the edge portion.

B: a fine line is filled with the toner evenly with the noticeable indentation in the edge portion.

C: a fine line is not filled with the toner evenly with outstanding indentation in the edge portion.

Irregularity in Half-Tone

The image quality is evaluated by visual inspection of a 30% half-tone image. The judgment criteria are as follows, and the acceptance criterion is the criterion A.

A: graininess is satisfactory without any irregularity.

B: graininess is less satisfactory with minor irregularities.

C: graininess is poor with irregularities.

Evaluation of Blisters

A recording test is conducted by printing a solid image on one surface to evaluate the occurrence level of blisters. A recording test is conducted after each kind of paper is allowed to stand in an environment at 28° C. and 85% RH for 48 hours. The resulting images are observed by the touch and visual inspection, and using an optical microscope according to the evaluation criteria as follows, and the acceptance criteria are the criterion A and the criterion B.

A: No blisters occur.

B: Blisters occur at a degree such that cannot be confirmed by visual inspection.

C: Blisters occur at a degree such that can be confirmed by visual inspection and cause image roughness.

D: Blisters occur at a degree such that can be confirmed by the touch and deteriorate image glossiness.

EXAMPLES 5 THROUGH 8 AND COMPARATIVE EXAMPLES 5 THROUGH 8)

Examples 5 through 8 and Comparative Examples 5 through 8 are conducted by combining the developer sets 1 through 6, the papers I through V, and the image forming apparatuses I through III as set forth in Table 2 below. In each example, the apparatus is set to a full-color mode for printing four colors and various images are printed while changing the TMA to within the range of 7.5 to 19.0 g/m$^2$ by adjusting a developing bias. Evaluation is made in the same manner as Example 1 and the like above. In Example 8, evaluation is made by providing the pre-heating device to the image forming apparatus I.

Results thus obtained are collectively set forth in Table 2 below.

TABLE 2

| | Developer Set | | | | | Image Roughness | | | |
|---|---|---|---|---|---|---|---|---|---|
| | No. | Bulk Density of Toner (g/cm$^3$) | Paper No. | Image Forming Apparatus | TMA (g/m$^2$) | Character | Half-Tone | Fine Line Reproducibility | Blister |
| Example 1 | 1 | 0.5 | I | I | 4.5 | A | A | A | B |
| Example 2 | 2 | 0.4 | I | II | 4.5 | A | A | A | B |
| Example 3 | 3 | 0.3 | I | III | 4.5 | A | A | A | B |
| Example 4 | 4 | 0.2 | I | I + pre-heating | 4.5 | A | A | A | B |
| Comparative Example 1 | 5 | 0.15 | I | I | 1.5 | C | C | C | B |
| Comparative Example 2 | 6 | 0.55 | II | I | 2.0 | C | C | C | B |
| Comparative Example 3 | 1 | 0.5 | III | I | 5.0 | C | C | C | B |
| Comparative Example 4 | 1 | 0.5 | I | I | 5.0 | C | C | C | B |
| Example 5 | 1 | 0.5 | I | I | 8.0 | A | A | A | B |
| Example 6 | 2 | 0.4 | II | II | 10 | A | A | A | B |
| Example 7 | 3 | 0.3 | V | III | 12 | A | A | A | B |
| Example 8 | 4 | 0.2 | V | I + pre-heating | 18 | A | A | A | B |
| Comparative Example 5 | 5 | 0.15 | I | I | 7.5 | B | A | B | D |
| Comparative Example 6 | 6 | 0.55 | III | I | 8.0 | B | B | B | D |
| Comparative Example 7 | 1 | 0.5 | IV | I | 19 | C | C | C | D |
| Comparative Example 8 | 1 | 0.5 | I | I | 19 | C | C | C | B |

Table 2 above reveals that neither image roughness, nor blisters that can be confirmed by visual inspection, occur in images obtained by the image forming method of the invention performed in each Example. On the contrary, either image roughness or blisters that can be confirmed by visual inspection, or both occur in images obtained in the Comparative Examples.

It is therefore understood that defects of a fixed image, such as image roughness and blisters, can be suppressed by using a toner having a specific bulk density.

According to the invention, it is possible to suppress image roughness and blisters occurring during the process of fixing the toner image without the need to strictly control a toner amount on a print medium according to print medium and print mode used, and therefore an image forming method capable of shortening a time needed to determine an optimum toner amount can be provided.

What is claimed is:

1. An image forming method, comprising:

forming an unfixed toner image on a surface of paper by an electrophotographic process using a developer containing a toner; and fixing the unfixed toner image on the paper, wherein a toner amount of the unfixed toner image is in a range of about 2.0 to 4.5 $g/m^2$ for a toner image formed using a toner of one color, and in a range of about 8.0 to 18 $g/m^2$ for a toner image formed by layering toners of four or more colors, and a bulk density of the toner is in a range of about 0.2 to 0.5 $g/cm^3$.

2. The image forming method according to claim 1, wherein the paper is coated paper in which a coating layer is formed on a surface of a base material, and air permeability and smoothness of the base material are in a range of about 400 to 4000 seconds and in a range of about 200 to 9000 seconds, respectively.

3. The image forming method according to claim 1, wherein a volume average particle size of the toner is in a range of about 2 to 7 μm.

4. The image forming method according to claim 1, wherein the fixing the unfixed toner image comprises passing the paper, on which the unfixed toner image is formed, through a nip portion, formed by a heated fixing roll and a press-bonding roll that are pressed against each other, in such a manner that a toner image carrying surface faces the heated fixing roll, to heat and press-bond the unfixed toner image.

5. The image forming method according to claim 1, wherein the fixing the unfixed toner image comprises passing the paper, on which the unfixed toner image is formed, through a nip portion, formed by a heated fixing roll and an endless belt that abuts an outer peripheral surface of the heated fixing roll, in such a manner that a toner image carrying surface faces the heated fixing roll, to heat and press-bond the unfixed toner image.

6. The image forming method according to claim 1, wherein the fixing the unfixed toner image comprises:

passing the paper, on which the unfixed toner image is formed, through a nip portion, formed by a fixing belt that has been heated before reaching the nip portion and a pressurizing belt that are pressed against each other, in such a manner that a toner image carrying surface faces the fixing belt, to heat and press-bond the unfixed toner image, moving the fixing belt and the paper carrying a fixed toner image on a surface thereof while maintaining close contact to each other, and separating the paper carrying the fixed toner image on the surface thereof from the fixing belt after the toner image is cooled to or below a predetermined temperature.

7. The image forming method according to claim 1, wherein the fixing the toner image comprises applying at least light energy to the paper on which the unfixed toner image is formed, so that the unfixed toner image is fixed in a non-contact manner.

8. The image forming method according to claim 1, wherein in the fixing the unfixed toner image, a dwell time is in a range of about 0.2 milliseconds to 2 seconds, the dwell time being a value obtained by dividing a distance in a moving direction of the paper within a heating region by a moving velocity of the paper.

9. The image forming method according to claim 1, further comprising pre-heating the paper, on which the unfixed toner image is formed, after the forming the unfixed toner image and before the fixing the unfixed toner image, so that a surface temperature on a toner image carrying side is about 50° C. or above.

10. The image forming method according to claim 1, wherein the toner contains a releasing agent in an amount of about 5 to 25% by mass relative to a total mass of solids forming the toner.

11. The image forming method according to claim 1, wherein a volume average particle size distribution index GSDv of the toner is about 1.28 or below.

12. The image forming method according to claim 1, wherein an average value of shape factor SF1 of the toner is in a range of about 100 to 140.

13. The image forming method according to claim 1, wherein the paper is coated paper in which a coating layer is formed on a surface of a base material.

14. The image forming method according to claim 1, wherein the paper is coated paper having a basis weight in a range of about 60 $g/m^2$ to 260 $g/m^2$.

15. The image forming method according to claim 1, wherein a fixing device having a dwell time in a range of about 0.4 milliseconds to 1.9 seconds is used, the dwell time being a value obtained by dividing a distance in a moving direction of the paper within a heating region by a moving velocity of the paper.

* * * * *